US007434912B2

(12) United States Patent
Murata

(10) Patent No.: US 7,434,912 B2
(45) Date of Patent: Oct. 14, 2008

(54) ULTRAFINE FLUID JET APPARATUS

(75) Inventor: Kazuhiro Murata, Tsukuba (JP)

(73) Assignee: National Institute of Advanced Industrial Science and Technology, Tokyo (JP)

( * ) Notice: Subject to any disclaimer, the term of this patent is extended or adjusted under 35 U.S.C. 154(b) by 555 days.

(21) Appl. No.: 10/504,536

(22) PCT Filed: Feb. 20, 2003

(86) PCT No.: PCT/JP03/01873

§ 371 (c)(1),
(2), (4) Date: Aug. 13, 2004

(87) PCT Pub. No.: WO03/070381

PCT Pub. Date: Aug. 28, 2003

(65) Prior Publication Data

US 2005/0116069 A1 Jun. 2, 2005

(30) Foreign Application Priority Data

| | | |
|---|---|---|
| Feb. 21, 2002 | (JP) | 2002-044299 |
| Aug. 13, 2002 | (JP) | 2002-235680 |
| Sep. 24, 2002 | (JP) | 2002-278183 |
| Dec. 25, 2002 | (JP) | 2002-375161 |

(51) Int. Cl.
*B41J 2/135* (2006.01)

(52) U.S. Cl. ..... 347/44; 347/47; 347/54

(58) Field of Classification Search ..... 347/47, 347/54, 55, 73, 74, 76, 79, 44
See application file for complete search history.

(56) References Cited

U.S. PATENT DOCUMENTS

| | | | | |
|---|---|---|---|---|
| 3,662,399 | A * | 5/1972 | Yanou et al. | 347/45 |
| 3,717,875 | A * | 2/1973 | Arciprete et al. | 347/73 |
| 3,921,916 | A * | 11/1975 | Bassous | 239/601 |
| 3,995,282 | A * | 11/1976 | d'Alton-Rauch et al. | 347/54 |

(Continued)

FOREIGN PATENT DOCUMENTS

| | | |
|---|---|---|
| JP | 36-13768 B | 5/1958 |

(Continued)

OTHER PUBLICATIONS

Gazou Denshi Jyohou Gakkai, vol. 17, No. 4, 1988, pp. 185-193.

*Primary Examiner*—Manish S Shah
(74) *Attorney, Agent, or Firm*—Birch, Stewart, Kolasch & Birch, LLP

(57) ABSTRACT

An ultrafine fluid jet apparatus including a substrate arranged near a distal end of an ultrafine-diameter nozzle to which a solution is supplied, and an optional-waveform voltage is applied to the solution in the nozzle to eject an ultrafine-diameter fluid droplet onto a surface of the substrate; wherein an electric field intensity near the distal end of the nozzle according to a diameter reduction of the nozzle is sufficiently larger than an electric field acting between the nozzle and the substrate; and wherein Maxwell stress and an electro-wetting effect being utilized, a conductance is decreased by a reduction in the nozzle diameter or the like, and controllability of an ejection rate by a voltage is improved; and wherein landing accuracy is exponentially improved by moderation of evaporation by a charged droplet and acceleration of the droplet by an electric field.

43 Claims, 29 Drawing Sheets

U.S. PATENT DOCUMENTS

| | | | | |
|---|---|---|---|---|
| 4,503,111 | A * | 3/1985 | Jaeger et al. | 428/32.14 |
| 4,679,059 | A * | 7/1987 | Dagna | 347/50 |
| 5,745,129 | A * | 4/1998 | Moriyama et al. | 347/12 |
| 6,312,110 | B1 * | 11/2001 | Darty | 347/55 |
| 6,357,855 | B1 * | 3/2002 | Kerekes et al. | 347/40 |
| 6,588,888 | B2 * | 7/2003 | Jeanmaire et al. | 347/77 |
| 2006/0170753 | A1 | 8/2006 | Higuchi et al. | |

FOREIGN PATENT DOCUMENTS

| | | | |
|---|---|---|---|
| JP | 41-16973 | B | 9/1965 |
| JP | 61-59911 | B | 12/1986 |
| JP | 6-27652 | U | 4/1994 |
| JP | 67151/1992 | A | 4/1994 |
| JP | 10-34967 | A | 2/1998 |
| JP | 10-315478 | A | 12/1998 |
| JP | 2000-127410 | A | 5/2000 |
| JP | 2001-38911 | A | 2/2001 |
| JP | 2001-38911 | A | 2/2001 |
| JP | 2001-88306 | A | 4/2001 |
| JP | 2001-232798 | A | 8/2001 |
| JP | 2001-232798 | A | 8/2001 |
| JP | 2001-239670 | A | 9/2001 |
| JP | 2001-239670 | A | 9/2001 |

* cited by examiner

ULTRAFINE FLUID JET APPARATUS

TECHNICAL FIELD

The present invention relates to an ultrafine droplet fluid jetting apparatus by applying a voltage near a fluid ejecting opening of ultrafine diameter, to eject an ultrafine fluid onto a substrate, and more particularly to an ultrafine fluid jet apparatus that can be used in dot formation, circuit pattern formation by metal particulates, ferroelectric ceramics patterning formation, conductive polymer alignment formation, or the like.

BACKGROUND ART

As a conventional inkjet recording system, a continuous system (for example, see JP-B-41-16973 ("JP-B" means examined Japanese patent publication)) that always pressure-sprays ink as a droplet from a nozzle by ultrasonic vibration, charges a flying ink droplet, and polarizes the ink droplet by an electric field, to continuously record an image. As a drop-on-demand system or the like for timely flying an ink droplet, an electrohydrodynamic system (for example, see JP-B-36-13768 and JP-A-2001-88306 ("JP-A" means unexamined published Japanese patent application)), which applies a potential across an ink ejecting portion and a sheet of recording paper, and attracts an ink droplet from the ink ejecting port by electrostatic force, to cause the ink droplet to adhere to the sheet of recording paper; a piezo-conversion system, or a thermal conversion system (for example, see JP-B-61-59911) such as a bubble jet (registered trademark) system (thermal system), are known.

As a drawing system for a conventional inkjet apparatus, a raster scan system, for displaying one image by using scan lines, has been used.

However, the conventional inkjet recording system poses the following problems.

(1) Difficulties in Ejection of an Ultrafine Droplet

Currently, in an inkjet system (piezo system or thermal system) that is practically and popularly used, a minute amount of liquid, smaller than 1 pl, cannot be easily ejected. This is because the pressure required for ejection increases as the diameter of the nozzle decreases to be finer.

In an electrohydrodynamic system, for example, a nozzle inner diameter described in JP-B-36-13768 is 0.127 mm, and the opening diameter of a nozzle described in JP-A-2001-88306 is 50 to 2000 μm, preferably 100 to 1000 μm. Therefore, it has been considered that an ultrafine droplet of size 50 μm or less cannot be ejected.

As will be described below, in an electrohydrodynamic system, extreme accuracy is required to control a driving voltage to realize a fine droplet.

(2) Luck of Landing Accuracy (Touchdown Accuracy)

Kinetic energy given to a droplet ejected from a nozzle decreases in proportion to the cube of the droplet radius. For this reason, a fine droplet cannot possess kinetic energy that is sufficient to withstand air resistance, and accurate landing cannot be expected, because of air convection or the like. In addition, as the droplet becomes fine, the effect of surface tension increases, which makes the vapor pressure of the droplet become high, and drastically increases the amount of evaporation. With this being the case, the mass of the flying fine droplet is considerably lost and even the shape of the droplet can hardly be kept in landing.

As described above, miniaturization and precision of a droplet and increased accuracy of landing positions thereof are incompatible subjects so that both cannot be easily realized at once.

Poor accuracy of landing positions not only deteriorates printing quality but also poses a considerable problem especially when the circuit pattern is drawn by using conductive ink, such as with an inkjet technique. More specifically, poor position accuracy not only makes it impossible to draw a wire having a desired width but also may cause disconnection or short-circuiting.

(3) Difficulties in Decrease of the Driving Voltage

When an inkjet technique according to an electrohydrodynamic system (for example, JP-B-36-13768), which is an ejection system different from the piezo system or the thermal system, is used, kinetic energy can be given by an applied electric field. However, since the apparatus is driven by a high voltage of over 1000 V, decreasing the size of the apparatus is limited. Although an apparatus described in JP-A-20001-88306 describes that a voltage of 1 to 7 kV is preferably used, a voltage of 5 kV is applied to in an example therein. To eject an ultrafine droplet and realize high throughput, introduction of multi-heads and high-density arrangement of heads are important factors. However, since the driving voltage in a conventional electrohydrodynamic inkjet system is very high, i.e., 1000 V or more, decreasing size and increasing density are difficult, because of leakage of current between the nozzles and interference between the nozzles, and decrease of driving voltage is a problem to be solved. In addition, a power semiconductor using a high voltage of more than 1000 V is generally expensive and has poor frequency responsiveness. In this case, the driving voltage is the total voltage applied to nozzle electrodes, and the sum of the bias voltage and the signal voltage (in this specification, the driving voltage means the total applied voltage, unless otherwise noted). In a conventional technique, a bias voltage is increased to decrease a signal voltage. However, in this case, a solute in an ink solution tends accumulate on nozzle surfaces by the bias voltage. The ink is fixed due to, for example, electrochemical reaction between the ink and the electrodes, and clogging of the nozzles or wasting of the electrodes disadvantageously occurs.

(4) Restriction of Usable Substrate and Layout of the Electrode

In a conventional electrohydrodynamic inkjet system (for example, JP-B-36-13768), a sheet of paper is assumed to be a recording medium, and a conductive electrode is required on the rear surface of the printing medium. There is a report that printing can be performed by using a conductive substrate as the printing medium, which, however, poses the following problem. When a circuit pattern is formed by an inkjet apparatus using conductive ink, if printing can only be performed on a conductive substrate, the circuit pattern cannot be directly used as an interconnection, and the application is considerably limited. For this reason, a technique that can also perform printing on an insulating substrate, such as glass and plastic, is needed. In addition, some conventional techniques in which an insulating substrate, such as glass, are used, is reported. However, an electrically conductive film is formed on the insulating substrate, or a counter electrode is arranged on the rear surface of the insulating substrate with decreasing the thickness of insulating substrate, so that a usable substrate or the layout of electrodes is limited.

(5) Instability of Ejection Control

In a conventional drop-on-demand electrohydrodynamic inkjet system (for example, JP-B-36-13768), a system that performs ejection control by turning on/off an applied voltage, or an amplitude modulation system that performs ejection control by applying a DC bias voltage to some extent and superposing a signal voltage thereon, is used. However, since the total applied voltage is high, i.e., 1000 V or more, the power semiconductor device to be used must be one that is expensive and poor in frequency responsiveness. Further, a method of applying a predetermined bias voltage, which is not enough to start ejection, and superposing a signal voltage on the bias voltage, to perform ejection control, is frequently used. However, when the bias voltage is high, aggregation of particles in ink is advanced in use of pigmented ink when ejection pauses; a nozzle is apt to be clogged by electrochemical reaction between electrodes and the ink, or other phenomena apt to occur. Thus, there are problems that time responsiveness when the ejection is restarted is poor, and the amount of liquid is disadvantageously unstable after the ejection pauses.

(6) Complexity of Structure

A structure achieved by a conventional inkjet technique is complex and is manufactured at high cost. In particular, an industrial inkjet system is very expensive.

Important design factors for a conventional electrohydrodynamic inkjet, in particular an on-demand electrohydrodynamic inkjet, are conductivity of the ink solution (e.g., resistivity of $10^6$ to $10^{11}$ Ωcm), surface tension (e.g., 30 to 40 dyn/cm), viscosity (e.g., 11 to 15 cp), and as an applied voltage (electric field), voltage applied to the nozzles and distance between the nozzles and the counter electrodes. For example, in the above conventional technique (JP-A-2001-88306), to form a stable meniscus to perform preferable printing, the distance between a substrate and nozzles is preferably set at 0.1 mm to 10 mm, more preferably 0.2 mm to 2 mm. A distance less than 0.1 mm is not preferable, as a stable meniscus cannot be formed.

Relationship between the nozzle diameter and the droplet to be generated is not made clear. This is mainly because a droplet attracted by an electrohydrodynamic system is attracted from the semilunar top (called a Taylor cone) of liquid formed by electrostatic force and forms a fluid jet having a diameter smaller than the nozzle diameter. For this reason, a nozzle diameter that is large, to some extent, has been allowed, to reduce clogging in the nozzle (for example, JP-A-10-315478, JP-A-10-34967, JP-A-2000-127410, JP-A-2001-88306, and the like).

A conventional electrohydrodynamic inkjet system uses electrohydrodynamic instability. FIG. 1(*a*) shows this manner as a schematic diagram. At this time, as an electric field, an electric field $E_0$, generated when a voltage V is applied across a counter electrode 102, which is arranged at a distance h from a nozzle 101, is set. When a conductive liquid 100*a* stands still in a uniform electric field, electrostatic force acting on the surface of the conductive liquid makes the surface instable, thereby promoting growth of a Taylor cone 100*b* (Taylor cone phenomenon). A growth wavelength λc set at this time can be physically derived, and is expressed by the following equation (e.g. GAZOU DENSHI JYOHOU GAKKAI, Vol. 17, No. 4, 1988, pp. 185-193):

$$\lambda_C = \frac{2\pi\gamma}{\varepsilon_0} E_0^{-2} \tag{1}$$

wherein γ is surface tension (N/m), $\in_0$ is vacuum dielectric constant (F/m), and $E_0$ is intensity of the electric field (V/m). Reference symbol d denotes a nozzle diameter (m). The growth wavelength λc means the shortest wavelength of a wave that can grow in waves generated by electrostatic force acting on the surface of the liquid.

As shown in FIG. 1(*b*), when the nozzle diameter d (m) is smaller than λc/2 (m), growth does not occur. More specifically, $$d > \frac{\lambda_C}{2} = \frac{\pi\gamma}{\varepsilon_0 E_0^2} \tag{2}$$

is a condition for ejection.

In this case, $E_0$ denotes the electric field intensity (V/m) obtained assuming that parallel flat plates are used. Then, following equation is obtained, representing the distance between the nozzle and the counter electrode by h (m), and the voltage applied to the nozzle by V.

$$E_0 = \frac{V}{h} \tag{3}$$

Therefore, $$d > \frac{\pi\gamma h^2}{\varepsilon_0 V^2} \tag{4}$$

is derived.

When the surface tension is given by γ=20 mN/m and γ=72 mN/m, the electric field intensity E required for ejectioin based on the idea of a conventional method is plotted with respect to the nozzle diameter d. The result is shown in FIG. 2. According to the idea of the conventional method, the electric field intensity is determined by the voltage applied to the nozzle, and by the distance between the nozzle and the counter electrode. For this reason, a reduction in nozzle diameter requires an increase in the electric field intensity required for ejection. In a conventional electrohydrodynamic inkjet, when the growth wavelength λc is calculated under typical operation conditions, i.e. a surface tension γ of 20 mN/m and an electric field intensity E of $10^7$ V/m, a value of 140 μm is obtained. Accordingly, as the limit nozzle diameter, a value of 70 μm is obtained. That is, under the above conditions, even if an electric field intensity of $10^7$ V/m is used, when the nozzle diameter is 70 μm or less, ink is not grown unless a process of applying back pressure to forcibly form a meniscus is performed, and it is considered that an electrohydrodynamic inkjet is not established. More specifically, a fine nozzle and a decrease in driving voltage are considered to be incompatible subjects. For this reason, as a conventional measure for a decrease in voltage, a method to achieve a decrease in voltage by arranging the counter electrode just in front of the nozzle, to shorten the distance of the nozzle and the counter electrode is employed.

DISCLOSURE OF INVENTION

In the present invention, the role of the nozzle that is accomplished in an electrohydrodynamic inkjet system is reconsidered. In a region given by $$d < \frac{\lambda_C}{2} \tag{5}$$

that is, $$d < \frac{\pi\gamma h^2}{\varepsilon_0 V^2} \tag{6}$$

or $$V < h\sqrt{\frac{\pi\gamma}{\varepsilon_0 d}} \tag{7}$$

and that is not tested hitherto because ejection is considered to be impossible, a fine droplet can be formed by applying Maxwell-force or the like in the present invention.

More specifically, the present invention provides an ultrafine fluid jet apparatus including, as a constituent element, a nozzle in which the intensity of the electric field near the distal end of the nozzle changed with a reduction in diameter of the nozzle is sufficiently larger than that of the electric field acting between the nozzle and a substrate, and using Maxwell-stress and Electrowetting effect.

With a reduction in the diameter of the nozzle, a decrease in driving voltage is attempted in the present invention.

According to the present invention, the flow-passage resistance is increased by reducing the diameter of the nozzle, to obtain a low conductance of $10^{-10}$ $m^3/s$, and controllability of an amount of ejection by a voltage is improved.

According to the present invention, landing accuracy (touchdown accuracy) is remarkably improved by using moderation of evaporation by a charged droplet and acceleration of a droplet by an electric field.

According to the present invention, the meniscus shape on the nozzle distal end face is controlled by using an optional waveform obtained considering dielectric moderation response, to make the concentration effect of an electric field more conspicuous, thereby attempting to improve ejection controllability.

The present invention provides an ultrafine fluid jet apparatus that attains to eject to an insulating substrate or the like by disusing a counter electrode.

Other and further features and advantages of the invention will appear more fully from the following description, taken in connection with the accompanying drawings.

BRIEF DESCRIPTION OF DRAWINGS

FIG. 1(*b*) is an explanatory diagram schematically showing a case in which a Taylor cone phenomenon does not occur.

BEST MODE FOR CARRYING OUT THE INVENTION

Figure 1:
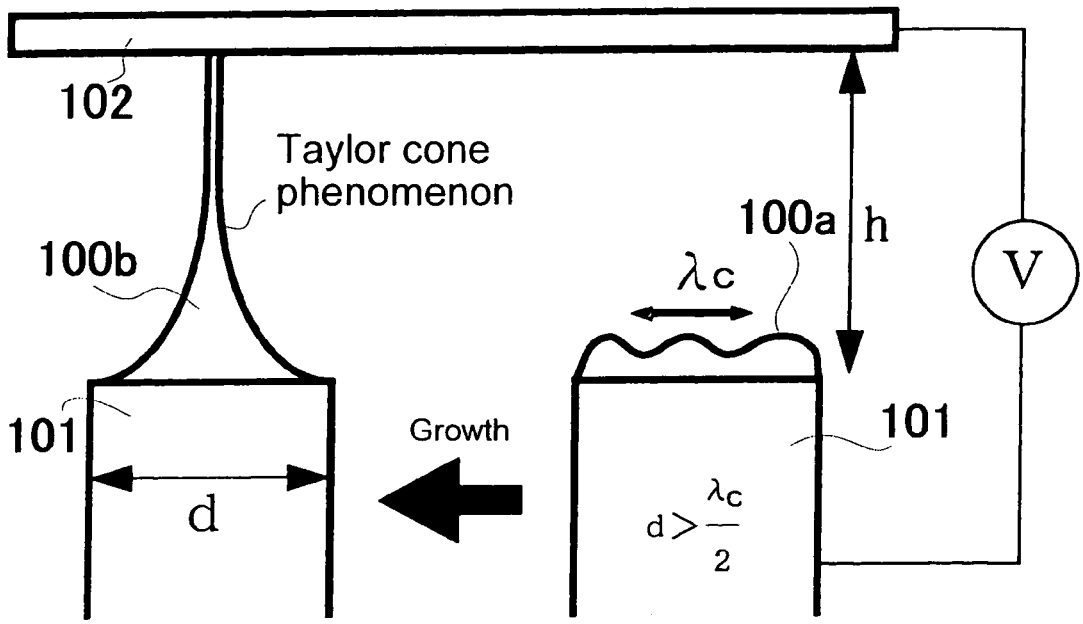
FIG. 1(*a*) is an explanatory diagram schematically showing the principle of growth by a Taylor cone phenomenon caused by electrohydrodynamic instability in a conventional electrohydrodynamic inkjet system.
Figure 1:
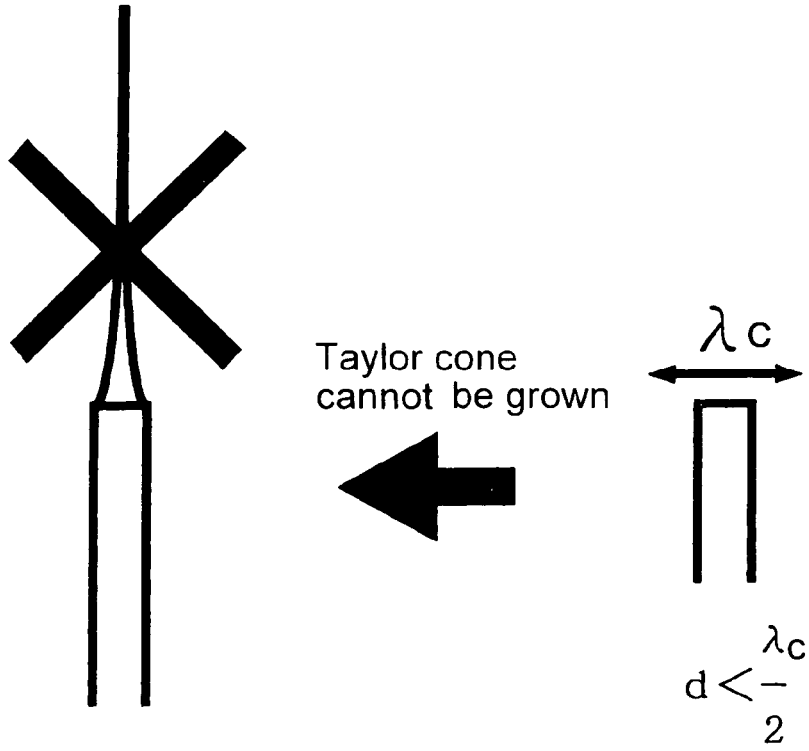

According to the present invention, there is provided the following means:

(1) An ultrafine fluid jet apparatus, comprising a substrate arranged near a distal end of an ultrafine-diameter nozzle to which a solution is supplied, and an optional-waveform voltage is applied to the solution in the nozzle, to eject an ultrafine-diameter fluid droplet onto a surface of the substrate; wherein an inner diameter of the nozzle is set at 0.01 μm to 25 μm so as to increase a concentrated electric field intensity on the distal end of the nozzle to decrease the applied voltage.

(2) The ultrafine fluid jet apparatus described in item (1), wherein the nozzle is made of an electric insulator, an electrode is arranged to be dipped in the solution in the nozzle, or an electrode is formed by plating, or vapor deposition, in the nozzle.

(3) The ultrafine fluid jet apparatus described in item (1), wherein the nozzle is made of an electric insulator, an electrode is inserted in the nozzle or is formed by plating, and an electrode is provided outside the nozzle.

(4) The ultrafine fluid jet apparatus described in any one of items (1) to (3), wherein the nozzle is a fine capillary tube of glass.

(5) The ultrafine fluid jet apparatus described in any one of items (1) to (4), wherein a flow passage of low conductance is connected to the nozzle, or the nozzle itself has a shape having low conductance.

(6) The ultrafine fluid jet apparatus described in any one of items (1) to (5), wherein the substrate is made of a conductive material or an insulating material.

(7) The ultrafine fluid jet apparatus described in any one of items (1) to (6), wherein the distance between the nozzle and the substrate is 500 μm or less.

(8) The ultrafine fluid jet apparatus described in any one of items (1) to (5), wherein the substrate is placed on a conductive or insulating substrate holder.

(9) The ultrafine fluid jet apparatus described in any one of items (1) to (8), wherein pressure is applied to the solution in the nozzle.

(10) The ultrafine fluid jet apparatus described in any one of items (1) to (9), wherein the applied voltage is set at 1000 V or less.

(11) The ultrafine fluid jet apparatus described in any one of items (2) to (10), wherein an optional-waveform voltage is applied to the electrode in the nozzle or the electrode outside the nozzle.

(12) The ultrafine fluid jet apparatus described in item (11), wherein an optional-waveform voltage generation device for generating the applied optional-waveform voltage is provided.

(13) The ultrafine fluid jet apparatus described in item (11) or (12), wherein the applied optional-waveform voltage is a DC voltage.

(14) The ultrafine fluid jet apparatus described in item (11) or (12), wherein the applied optional-waveform voltage is a pulse-waveform.

(15) The ultrafine fluid jet apparatus described in item (11) or (12), wherein the applied optional-waveform voltage is an AC voltage.

(16) The ultrafine fluid jet apparatus described in any one of items (1) to (15), wherein the optional-waveform voltage V (volt) applied to the nozzle is given in a region expressed by:

$$h\sqrt{\frac{\gamma\pi}{\varepsilon_0 d}} > V > \sqrt{\frac{\gamma k d}{2\varepsilon_0}} \tag{15}$$

and wherein γ is a surface tension (N/m) of the fluid, $\in_0$ is the dielectric constant (F/m) of a vacuum, d is a nozzle diameter (m), h is a distance between the nozzle and the substrate (m), and k is a the proportionality constant (1.5<k<8.5) depending on nozzle shape.

(17) The ultrafine fluid jet apparatus described in any one of items (1) to (16), wherein the applied optional-waveform voltage is 700 V or less.

(18) The ultrafine fluid jet apparatus described in any one of items (1) to (16), wherein the applied optional-waveform voltage is 500 V or less.

(19) The ultrafine fluid jet apparatus described in any one of items (1) to (18), wherein the distance between the nozzle and the substrate is made constant, and the applied optional-waveform voltage is controlled to control ejection of a fluid droplet.

(20) The ultrafine fluid jet apparatus described in any one of items (1) to (18), wherein the applied optional-waveform voltage is made constant, and the distance between the nozzle and the substrate is controlled to control ejection of the fluid droplet.

(21) The ultrafine fluid jet apparatus described in any one of items (1) to (18), wherein the distance between the nozzle and the substrate, and the applied optional-waveform voltage, are controlled to control ejection of the fluid droplet.

(22) The ultrafine fluid jet apparatus described in item (15), wherein the applied optional-waveform voltage is an AC voltage, and a meniscus shape of the fluid on the nozzle end face is controlled by controlling a frequency of the AC voltage, to control ejection of the fluid droplet.

(23) The ultrafine fluid jet apparatus described in any one of items (1) to (22), wherein an operating frequency used when ejection is controlled is modulated by frequencies f (Hz), which sandwich a frequency, and which is expressed by:

$$f=\sigma/2\pi\in$$

to perform ON-OFF ejection control, and wherein σ is a dielectric constant ($S\cdot m^{-1}$) of the fluid, and ∈ is a specific inductive capacity of the fluid.

(24) The ultrafine fluid jet apparatus described in any one of item (1) to (22), wherein, when ejection is performed by a single pulse, a pulse width Δt having a time constant τ or more determined by:

$$\tau = \frac{\varepsilon}{\sigma} \tag{20}$$

is applied, and wherein ∈ is a specific inductive capacity of the fluid, and σ is a conductivity ($S\cdot m^{-1}$) of the fluid.

(25) The ultrafine fluid jet apparatus described in any one of items (1) to (22), wherein, a flow rate per unit time in application of a driving voltage is set at $10^{-10}$ $m^3/s$ or less when the flow rate Q in a cylindrical flow passage is expressed by:

$$Q = \frac{4\pi d^3}{\eta L}\left(\frac{2\varepsilon_0 V^2}{kd} - \gamma\right) \tag{19}$$

and wherein d is a diameter (m) of the flow passage, η is a viscosity coefficient (Pa·s) of the fluid, L is a length (m) of the flow passage, $\in_0$ is the dielectric constant ($F\cdot m^{-1}$) of a vacuum, V is an applied voltage (V), γ is a surface tension ($N\cdot m^{-1}$) of the fluid, and k is a proportionality constant ($1.5<k<8.5$) depending on nozzle shape.

(26) The ultrafine fluid jet apparatus described in any one of items (1) to (25), which is used in formation of a circuit pattern.

(27) The ultrafine fluid jet apparatus described in any one of items (1) to (25), which is used in formation of a circuit pattern using metal ultrafine particles.

(28) The ultrafine fluid jet apparatus described in any one of items (1) to (25), which is used in formation of a carbon nanotube, a precursor thereof, and a catalytic configuration.

(29) The ultrafine fluid jet apparatus described in any one of items (1) to (25), which is used in formation of a patterning of ferroelectric ceramics and a precursor thereof.

(30) The ultrafine fluid jet apparatus described in any one of items (1) to (25), which is used in high-degree configuration for a polymer and a precursor thereof.

(31) The ultrafine fluid jet apparatus described in any one of items (1) to (25), which is used in zone refining.

(32) The ultrafine fluid jet apparatus described in any one of items (1) to (25), which is used in micro-bead manipulation.

(33) The ultrafine fluid jet apparatus described in any one of items (1) to (32), wherein the nozzle is actively tapped to the substrate.

(34) The ultrafine fluid jet apparatus described in item (33), which is used in the formation of a three-dimensional structure.

(35) The ultrafine fluid jet apparatus described in any one of items (1) to (32), wherein the nozzle is arranged obliquely to the substrate.

(36) The ultrafine fluid jet apparatus described in any one of items (1) to (35), wherein a vector scan system is employed.

(37) The ultrafine fluid jet apparatus described in any one of items (1) to (35), wherein a raster scan system is employed.

(38) The ultrafine fluid jet apparatus described in any one of items (1) to (37), wherein a polyvinylphenol (PVP) ethanol solution is spin-coated on the substrate to modify the surface of the substrate.

The nozzle inner diameter of the ultrafine fluid jet apparatus according to the present invention is 0.01 to 25 μm, preferably 0.01 to 8 μm. The "ultrafine fluid-diameter fluid droplet" is a droplet having a diameter which is generally 100 μm or less, preferably 10 μm or less. More specifically, the droplet has a diameter of 0.0001 μm to 10 μm, more preferably 0.001 μm to 5 μm.

In the present invention, the "optional-waveform voltage" means a DC voltage, an AC voltage, a unipolar single pulse, a unipolar multi-pulse, a bipolar multi-pulse string, or a combination thereof.

When a voltage is directly applied to a liquid in an insulating nozzle, an electric field is generated depending on the shape of the nozzle. The intensity of the electric field generated at this time is conceptually expressed by a density of electric flux lines drawn from the nozzle to the substrate. In the present invention, "focused on the distal end of the nozzle" means that, at this time, the density of the electric flux lines at the distal end of the nozzle becomes high to locally increase the electric field intensity at the distal end of the nozzle.

The "focused electric field intensity" means an electric field intensity which is locally increased as a result of the increase of density of the electric flux lines.

The "increase of the focused electric field intensity" means that, as the lowest electric field intensity, a component ($E_{loc}$) caused by the shape of the nozzle, a component ($E_0$) depending on an inter-nozzle-substrate distance, or a combined component of these components, is to be set at an electric field intensity of preferably $1\times10^5$ V/m or more, more preferably $1\times10^6$ V/m or more.

In the present invention, the "decrease in voltage" concretely means that the voltage is set at a voltage lower than 1000 V. This voltage is preferably 700 V or less, more preferably 500 V or less, still more preferably 300 V or less.

The present invention will be further described in detail.

(Method of Decrease of Driving Voltage and Realization of Minutes-quantity Ejection)

After various experiments and considerations are repeated, an equation for approximately expressing an ejection condition and the like for realizing a decrease in driving voltage and realization of minutes-quantity ejection is derived. The equation is described below.

Figure 3:
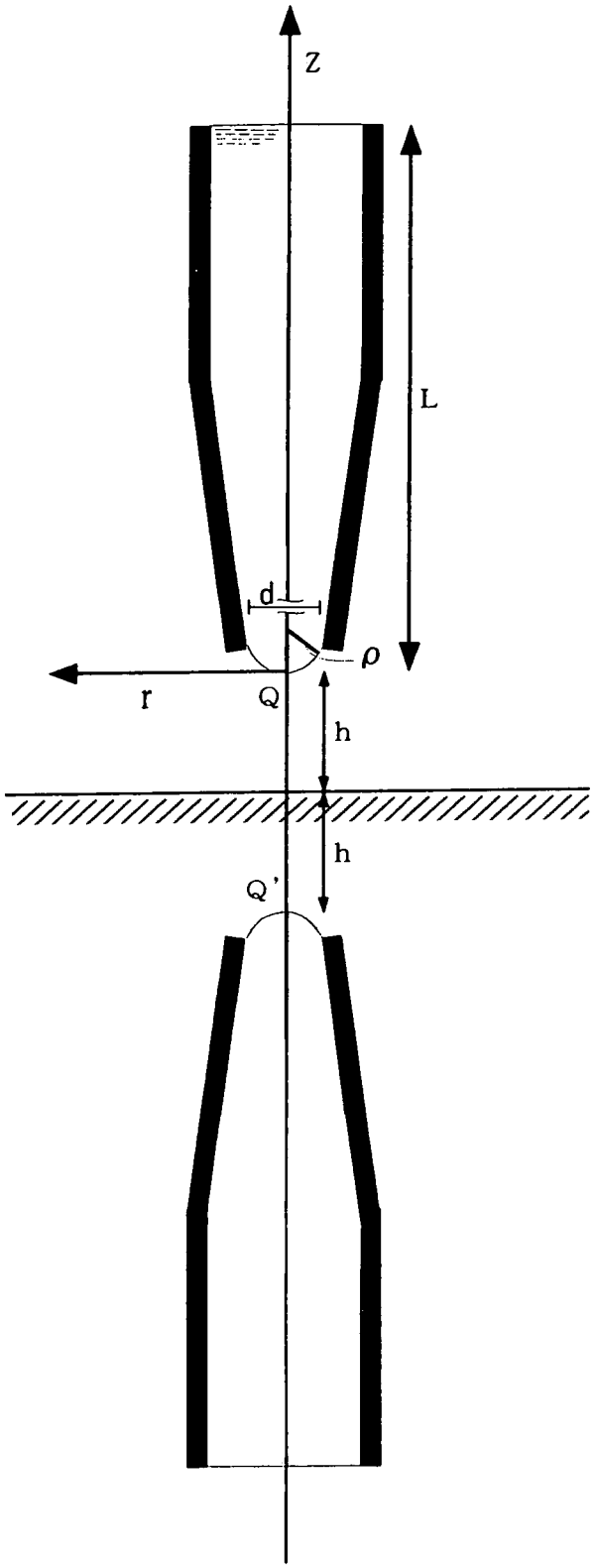
FIG. 3 is a schematic diagram explaining calculation of the electric field intensity of the nozzle according to the present invention.

FIG. 3 schematialy shows a manner of injecting conductive ink into a nozzle having a diameter d (In this specification, unless otherwise noted, the diameter indicates an inner diameter of the distal end of the nozzle.) to position the conductive ink at a height h above an infinite plane conductor. A counter electrode or a conductive substrate is considered now. The nozzle is arranged at a height h above the counter electrode or the conductive substrate. It is assumed that a substrate area is sufficiently larger than a distance h between the nozzle and the substrate. At this time, the substrate can be approximated as an infinite plane conductor. In FIG. 3, reference symbol r denotes a direction parallel to the infinite plane conductor, and reference symbol Z denotes a Z-axis (height) direction. Reference symbol L denotes a length of a flow passage, and reference symbol ρ denotes a curvature radius.

At this time, it is assumed that a charge induced at the distal end of the nozzle is focused on a hemispherical portion of the distal end of the nozzle. The charge can be approximately expressed by the following equation:

$$Q=2\pi\in_0\alpha Vd \tag{8}$$

wherein Q is the charge (C) induced at the distal end of the nozzle, $\in_0$ is the dielectric constant ($F\cdot m^{-1}$) of vacuum, d is the diameter (m) of the nozzle, and V is the total voltage (V) applied to the nozzle. Reference symbol α denotes a proportional constant depending on a nozzle shape or the like which exhibits a value of about 1 to 1.5. In particular, when d<<h is satisfied, the proportional constant is about 1. Note that reference symbol h denotes the inter-nozzle-substrate distance (m).

In addition, when the conductive substrate is used, it is considered that image charge Q' having opposing signs are induced to symmetrical positions in the substrate. When the substrate is an insulating substrate, image charge Q' having opposing sign is similarly induced to symmetrical positions determined by a dielectric constant.

It is assumed that a curvature radius is represented by ρ. In this case, the focused electric field intensity $E_{loc.}$ at the distal end of the nozzle is given by:

$$E_{loc.}=\frac{V}{k\rho} \tag{9}$$

wherein k is a proportional constant. The proportional constant k changes depending on nozzle shape or the like, exhibits a value of about 1.5 to 8.5. In many cases, it is considered that the value is about 5 (P. J. Birdseye and D. A. Smith, Surface Science, 23 (1970) see pp. 198-210).

For descriptive convenience, it is assumed that ρ=d/2. This corresponds to a state in which the conductive ink rises in a semispherical shape having a curvature radius equal to the nozzle diameter d at the distal end of the nozzle by the surface tension.

Balance of pressure acting on the liquid at the distal end of the nozzle will be considered. When a liquid area at the distal end of the nozzle is represented by S ($m^2$), an electrostatic pressure Pe (Pa) is expressed by the following equation.

$$P_e=\frac{Q}{S}E_{loc.}=\frac{Q}{\pi d^2/2}E_{loc.} \tag{10}$$

When α=1, from equations (8), (9), and (10), the following equation is obtained.

$$P_e=\frac{4\varepsilon_0 V}{d}\frac{2V}{kd}=\frac{8\varepsilon_0 V^2}{kd^2} \tag{11}$$

On the other hand, when a pressure obtained by the surface tension of the liquid at the distal end of the nozzle is represented by Ps (Pa), the following equation is established:

$$P_s=\frac{4\gamma}{d} \tag{12}$$

wherein γ is surface tension (N/m).

Since a condition in which fluid is ejected by electrostatic force is a condition in which the electrostatic force is stronger than the surface tension, the following condition is established.

$$P_e>P_s \tag{13}$$

Figure 4:
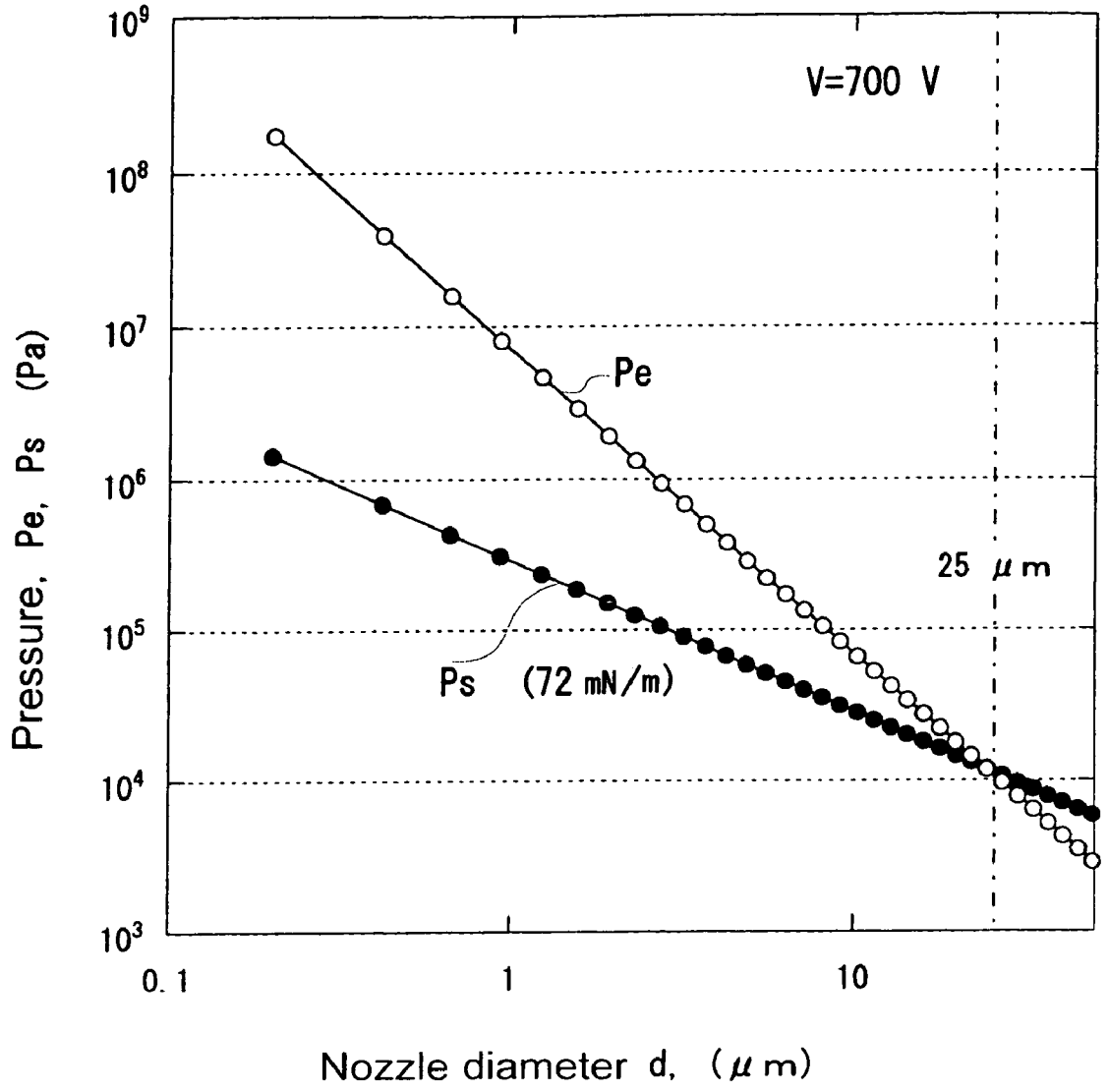
FIG. 4 is a graph showing an example of dependency of surface tension pressure and electrostatic pressure on nozzle diameter according to the present invention.

FIG. 4 shows a relation between a pressure obtained by a surface tension and an electrostatic pressure when a nozzle having a certain diameter d is given. As the surface tension, a surface tension related to water (γ=72 mN/m) is shown. It is assumed that a voltage applied to the nozzle is set at 700 V. In this case, when the nozzle diameter d is 25 μm or less, it is shown that an electrostatic pressure is stronger than the surface tension.

When the relationship between V and d is obtained from this relational expression, the lowest voltage for ejection is given by.

$$V>\sqrt{\frac{\gamma kd}{2\varepsilon_0}} \tag{14}$$

More specifically, from equation (7) and equation (14), an operating voltage V of the present invention satisfies the following condition.

$$h\sqrt{\frac{\gamma\pi}{\varepsilon_0 d}}>V>\sqrt{\frac{\gamma kd}{2\varepsilon_0}} \tag{15}$$

An ejection pressure ΔP (Pa) at this time satisfies following equation.

$$\Delta P=P_e-P_s \tag{16}$$

Therefore, the following equation is satisfied.

$$\Delta P=\frac{8\varepsilon_0 V^2}{kd^2}-\frac{4\gamma}{d} \tag{17}$$

Figure 5:
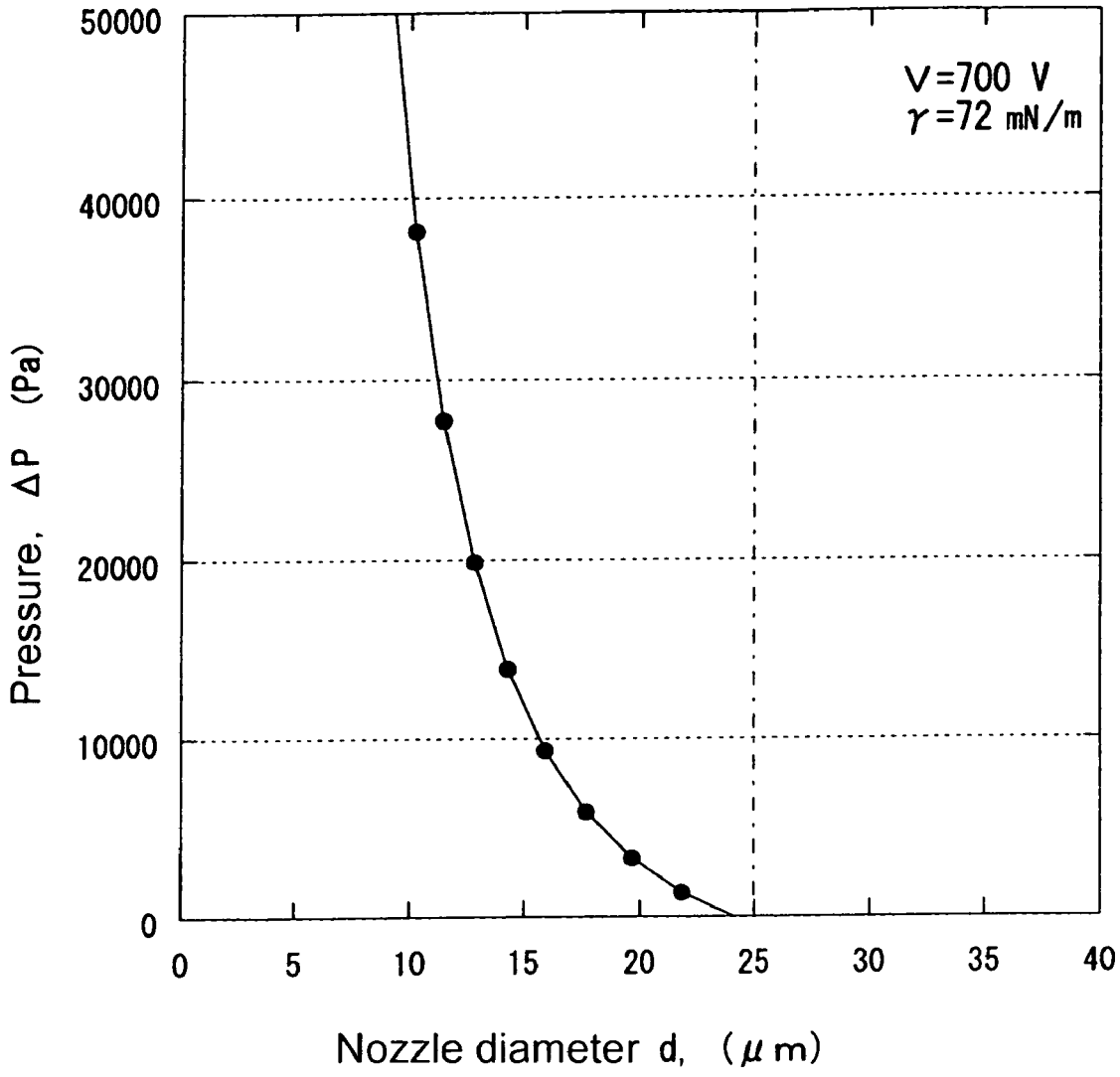
FIG. 5 is a graph showing an example of dependency of ejection pressure on nozzle diameter according to the present invention.
Figure 6:
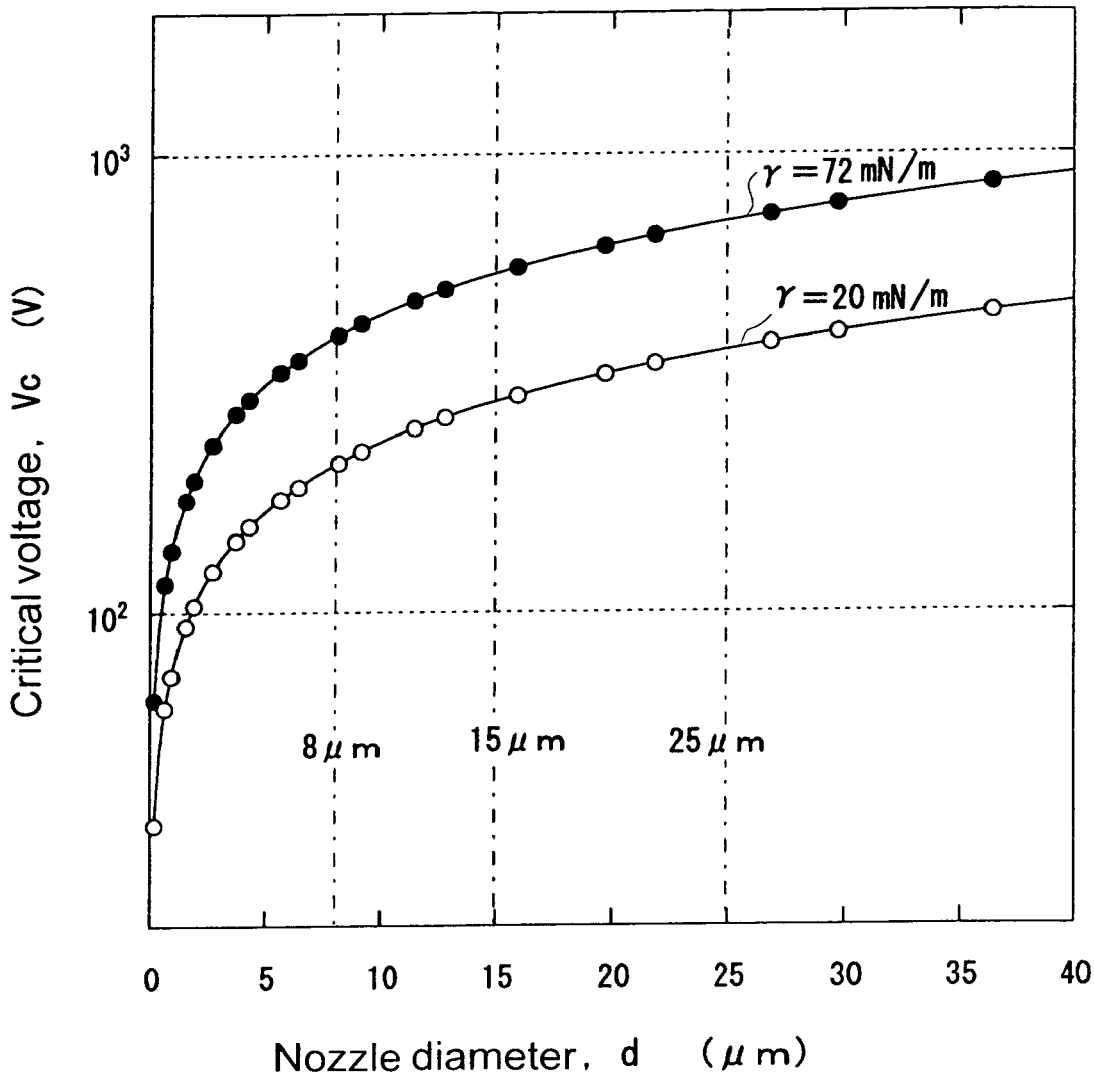
FIG. 6 is a graph showing an example of dependency of ejection limit voltage on nozzle diameter according to the present invention.

When an ejection condition is satisfied by a local electric field intensity, dependence of the ejection pressure ΔP on a nozzle having a certain diameter d is shown in FIG. 5, and dependence of an ejection critical voltage Vc on the same is shown in FIG. 6.

As is apparent from FIG. 5, the upper limit of the nozzle diameter when the ejection condition is satisfied by the local electric field intensity is 25 μm.

In a calculation in FIG. 6, water which satisfies γ=72 mN/m and an organic solvent γ=20 mN/m are assumed, and a condition given by k=5 is presumed.

As is apparent from this graph, when the effect of electric field concentration by the fine nozzle is considered, the ejection critical voltage decreases with the reduction in nozzle diameter. When water which satisfies $\gamma$=72 mN/m is used, it is understood that the ejection critical voltage is about 700 V when the nozzle diameter is 25 μm.

Figure 2:
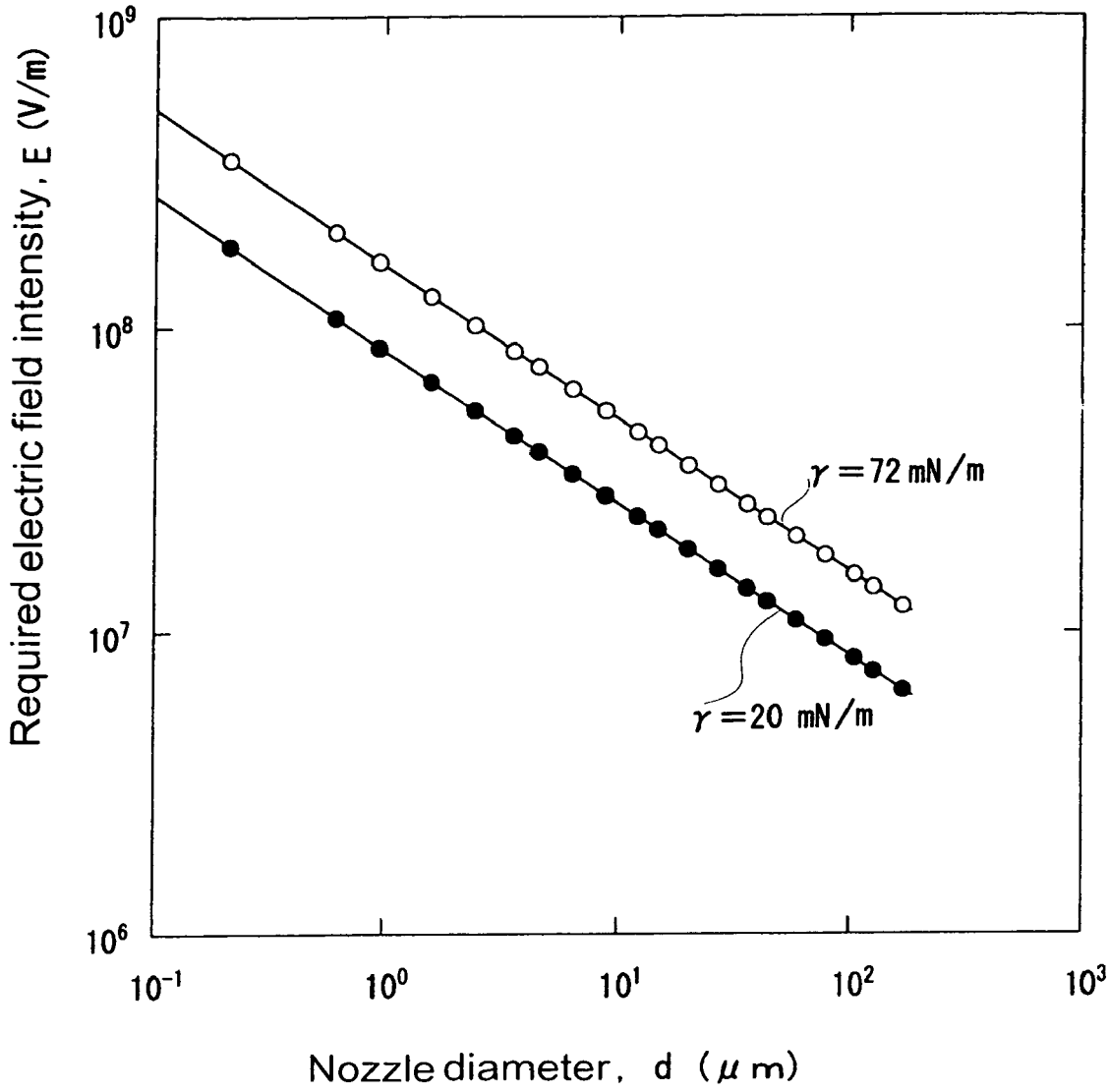
FIG. 2 is a graph showing the electric field intensity required for ejection, calculated based on design guidance for a conventional inkjet technique, with respect to nozzle diameter.
Figure 7:
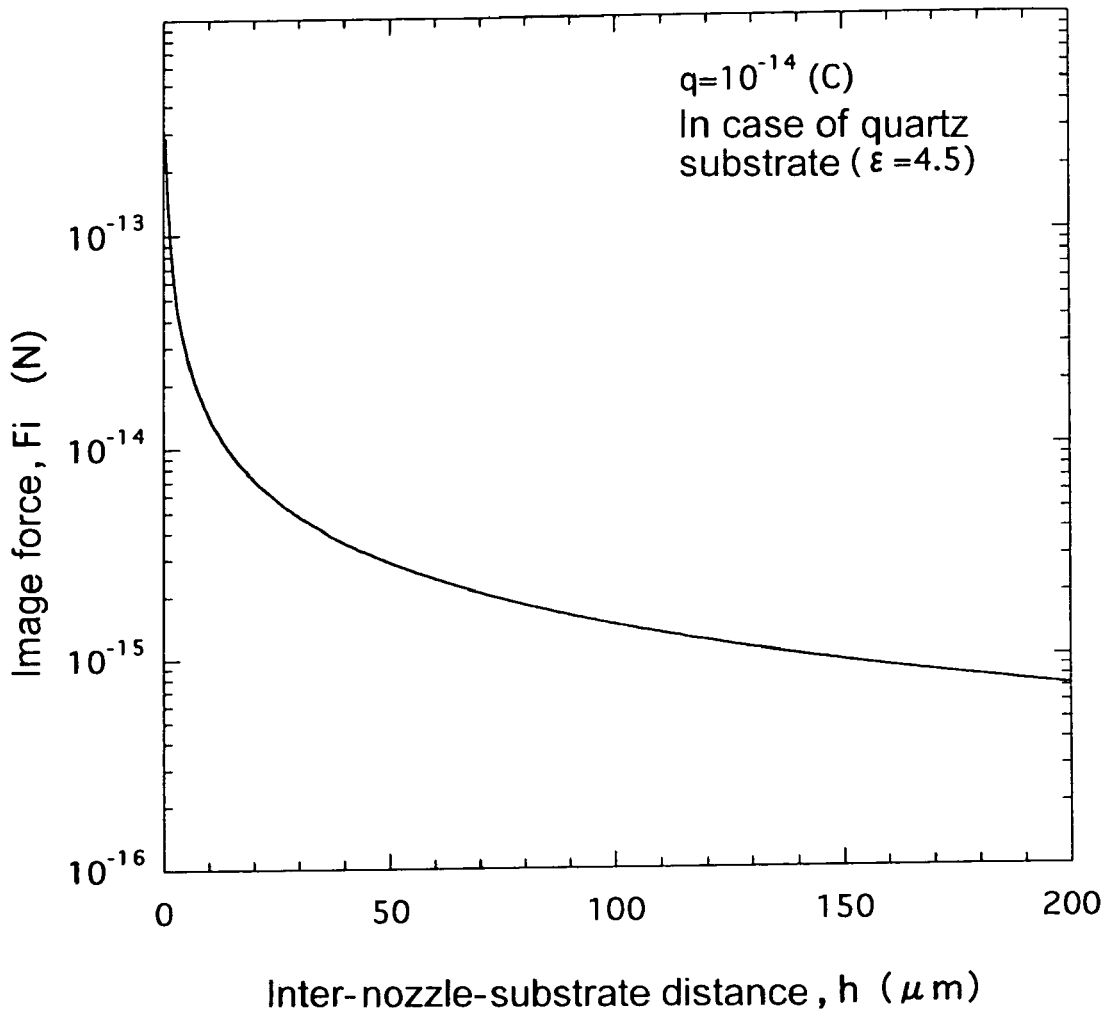
FIG. 7 is a graph showing an example correlation between image force acting between a charged droplet and a substrate, and inter-nozzle-substrate distance, according to the present invention.

This significance is apparent when FIG. 6 is compared with FIG. 2. In a conventional idea about an electric field, i.e., when only an electric field defined by a voltage applied to a nozzle and a distance between counter electrodes is considered, a voltage required for ejection increases with a reduction in nozzle diameter. On the other hand, when attention is given to a local electric field intensity, an ejection voltage can be decreased by applying a fine nozzle. In addition, since an electric field intensity required for ejection is dependent on a local focused electric field intensity, the presence of the counter electrodes is not essential. More specifically, printing can be performed on an insulating substrate or the like without a counter electrode, and a degree of freedom of the apparatus configuration increases. Printing can also be performed to a thick insulator. A droplet separated from the nozzle, by the operation of Maxwell stress generated by the locally focused electric field, is given with kinetic energy. The flying droplet gradually loses the kinetic energy by air resistance. However, since the droplet is charged, image force acts between the droplet and the substrate. A correlation (when $q=10^{-14}$ (C), and when a quartz substrate ($\in$=4.5) is used) between the magnitude of the image force Fi (N) and a distance h (μm) from the substrate is shown in FIG. 7. As is apparent from FIG. 7, the image force becomes conspicuous as the distance between the substrate and the nozzle decreases. In particular, the image force is conspicuous when h is 20 μm or less.

(Accurate Control of Micro Flow Rate)

A flow rate Q in a cylindrical flow passage is expressed by the following Hagen-Poiseuille's equation in viscous flow. When a cylindrical nozzle is assumed, the flow rate Q of a fluid flowing in the nozzle is expressed by the following equation:

$$Q = \frac{\pi \Delta P}{\eta L} d^4 \tag{18}$$

wherein $\eta$ is a viscosity coefficient (Pa·s) of fluid, L is a flow passage, i.e., length of nozzle (m), d is a flow passage, i.e., diameter (m) of nozzle, and $\Delta P$ is a pressure difference (Pa). According to the above equation, the flow rate Q is in proportion to the biquadrate of the radius of the flow passage. In order to regulate the flow rate, a fine nozzle is effectively employed. The ejection pressure $\Delta P$ obtained by equation (17) is substituted in equation (18) to obtain the following equation.

$$Q = \frac{4\pi d^3}{\eta L}\left(\frac{2\varepsilon_0 V^2}{kd} - \gamma\right) \tag{19}$$

Figure 8:
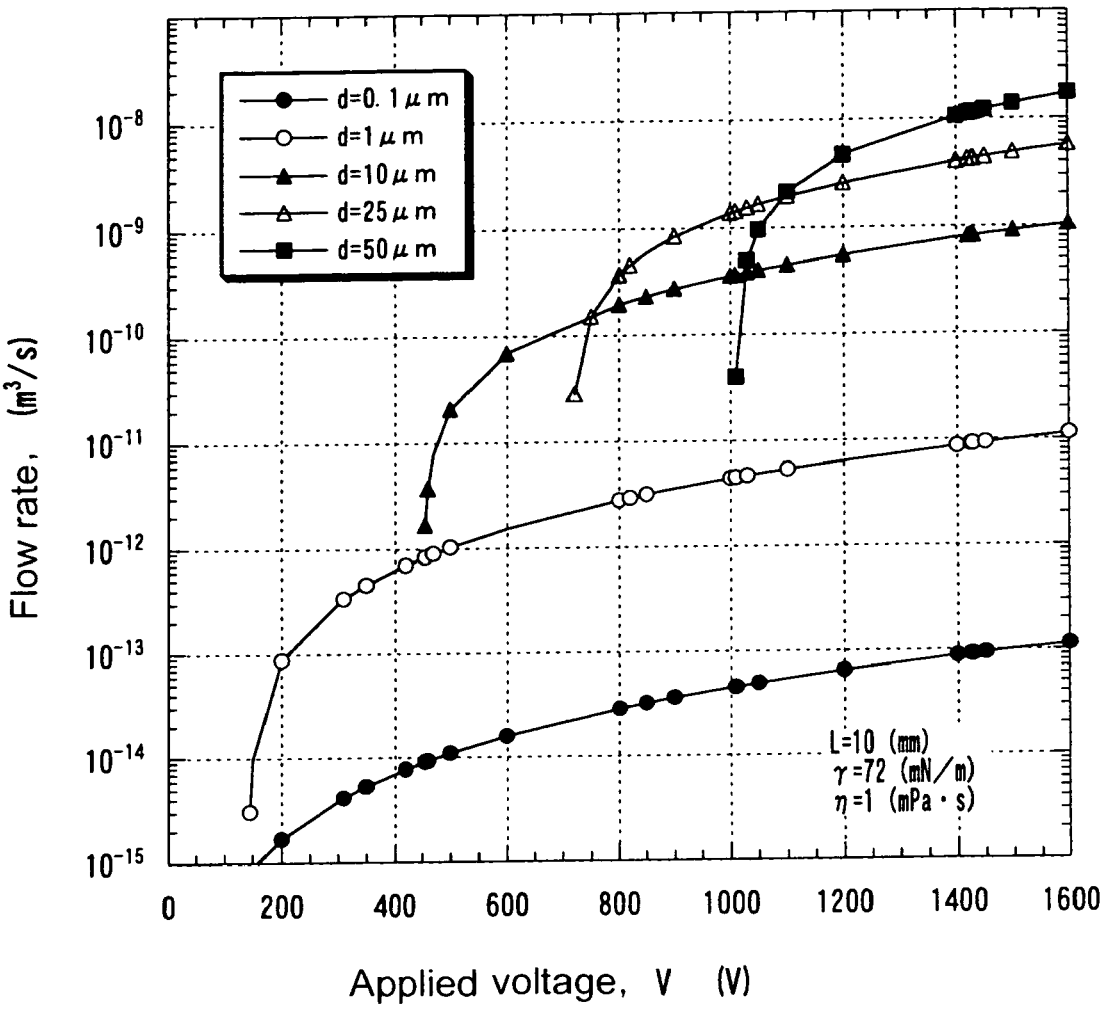
FIG. 8 is a graph showing an example correlation between the flow rate of ink flowing from the nozzle, and applied voltage, according to the present invention.

This equation expresses an outflow rate of the fluid flowing out of the nozzle having a diameter d and a length L when a voltage V is applied to the nozzle. This manner is shown in FIG. 8. In the calculation, values L=10 mm, $\eta$=1 (mPa·s), and $\gamma$=72 (mN/m) are used. The diameter of the nozzle is set at the minimum value of 50 μm in the conventional method, and the voltage V is gradually applied. In this case, ejection is started when the voltage V=1000 V. This voltage corresponds to the ejection start voltage described in FIG. 6. A flow rate of the fluid flowing from the nozzle at this time is plotted on the Y-axis. The flow rate sharply rises immediately over the ejection start voltage Vc. In this model calculation, it is supposed that a micro flow rate can be obtained by accurately controlling the voltage at a level slightly higher than the voltage Vc. However, as is predicted from FIG. 8 expressed by semilogarithm, the micro flow rate cannot be obtained in practice. In particular, a micro flow rate of $10^{-10}$ $m^3/s$ or less can hardly be realized. When a nozzle having a certain diameter is employed, as is given by equation (14), the minimum driving voltage is determined. For this reason, as in the conventional method, as long as a nozzle having a diameter of 50 μm or more is used, it is difficult to obtain a micro ejection rate of $10^{-10}$ $m^3/s$ or less and a driving voltage of 1000 V or less.

As is apparent from FIG. 8, when a nozzle having a diameter of 25 μm is used, a driving voltage of 700 V or less is sufficient. When a nozzle having a diameter of 10 μm is used, a flow rate can be controlled at a driving voltage of 500 V or less.

It is understood that when a nozzle having a diameter of 1 μm is used, a driving voltage of 300 V or less may be used.

In the above description, continuous flow is assumed. However, in order to form a droplet, switching is necessary. The switching will be described below.

Electrohydrodynamic ejection is based on charging of a fluid at the distal end of the nozzle. A charging rate is considered to be almost equal to a time constant determined by dielectric relaxation:

$$\tau = \frac{\varepsilon}{\sigma} \tag{20}$$

where $\tau$ is a dielectric relaxation time (sec), $\in$ is a specific inductive capacity of fluid, and $\sigma$ is a conductivity ($S \cdot m^{-1}$) of fluid. It is assumed that the dielectric constant ($\in_r$) of the fluid and the conductivity are set at 10 and $10^{-6}$ S/m, respectively. In this case, $\tau$ is equal to $8.854 \times 10^{-5}$ sec. On the other hand, when a critical frequency is represented by fc (Hz), the following equation is satisfied.

$$f_C = \frac{\sigma}{\varepsilon} \tag{21}$$

Since response cannot be performed to a change of an electric field having a frequency higher than the frequency fc, ejection may be impossible. When the above example is estimated, the frequency is about 10 kHz.

(Evaporation Moderation by Charged Droplet)

A generated fine droplet immediately vapors through the influence of surface tension. For this reason, even though a fine droplet is managed to be generated, the fine droplet may be eliminated before the fine droplet reaches a substrate. In a charged droplet, it is known that a vapor pressure P obtained after charging satisfies the following relational expression by using a vapor pressure $P_0$ obtained before charging and a charge amount q of the droplet:

$$\frac{RT\rho}{M}\log_e\frac{P}{P_0}=\frac{2\gamma}{r}-\frac{q^2}{8\pi r^4} \tag{22}$$

wherein R is the gas constant ($J\cdot mol^{-1}\cdot K^{-1}$), T is absolute temperature (K), ρ is vapor concentration ($Kg/m^3$), γ is surface tension (mN/m), q is electrostatic charge (C), M is molecular mass of gas, and r is a droplet radius (m). When equation (22) is rewritten, the following is obtained.

$$\log_e P=\log_e P_0+\frac{M}{RT\rho}\left(\frac{2\gamma}{r}-\frac{q^2}{8\pi r^4}\right) \tag{23}$$

This equation expresses that, when the droplet is charged, the vapor pressure decreases to make evaporation difficult. As is apparent from the term in parentheses of the right side member of equation (23), this effect becomes conspicuous as the droplet decreases in size. For this reason, in the present invention that has as its object to eject a droplet which is finer than that of the conventional method, it is effective to moderate evaporation that the droplet is flied in a charged stated. In particular, being flied in an atmosphere comprising the ink solvent is all the more effective. The control of the atmosphere is also effective in relief of clogging of the nozzle.

(Decrease in Surface Tension by Electrowetting)

An insulator is arranged on an electrode, and a voltage is applied across liquid dropped on the insulator and the electrode. In this case, it is found that a contact area between the liquid and the insulator increases, i.e., wettability is improved. This phenomenon is called an electrowetting phenomenon. As this effect also holds in a cylindrical capillary shape, the phenomenon is also called electrocapillary. A pressure $P_{ec}$ (Pa) obtained by the electrowetting effect, an applied voltage, the shape of a capillary, and the physical values of a solution satisfy a relation expressed by the following equation:

$$P_{ec}=\frac{2\varepsilon_0\varepsilon_r}{t}\frac{V^2}{d} \tag{24}$$

wherein $\in_0$ is the dielectric constant ($F\cdot m^{-1}$) of vacuum, $\in_r$ is a dielectric constant of insulator, t is a thickness (m) of insulator, and d is a inner diameter (m) of capillary. This value will be calculated by using water as a fluid. The value is calculated in an example of a conventional technique (JP-B-36-13768), the value is 30000 Pa (0.3 atm) at most. In the present invention, it is understood that an electrode is arranged outside the nozzle to obtain an effect corresponding to 30 atm. In this manner, even though a fine nozzle is used, supply of a fluid to the distal end of the nozzle is rapidly performed by the effect. This effect is conspicuous as the dielectric constant of the insulator increases and as the thickness of the insulator decreases. In order to obtain the electrocapillary effect, strictly speaking, an electrode arranged with an insulator is necessary. However, when a sufficient electric field is applied to a sufficient insulator, the same effect as described above can be obtained.

In the above discussion, unlike the conventional technique in which an electric field determined by the voltage V applied to the nozzle and the distance h between the nozzle and the counter electrode, a point to notice is that these approximate theories are based on an electric field intensity localized at the distal end of the nozzle. In addition, it is important in the present invention that an electric field is locally intense and that the flow passage for supplying the fluid has very low conductance. It is also important that the fluid itself is sufficiently charged in a micro area. When a dielectric material such as a substrate or a conductor is got close to the charged micro fluid, image force acts on the micro fluid to fly perpendicularly to the substrate.

For this purpose, in the following embodiment, as a nozzle, a glass capillary is used because the glass capillary can be easily formed. However, the nozzle is not limited to the glass capillary.

In the following, some embodiments of the present invention are described referring to the drawings.

Figure 9:
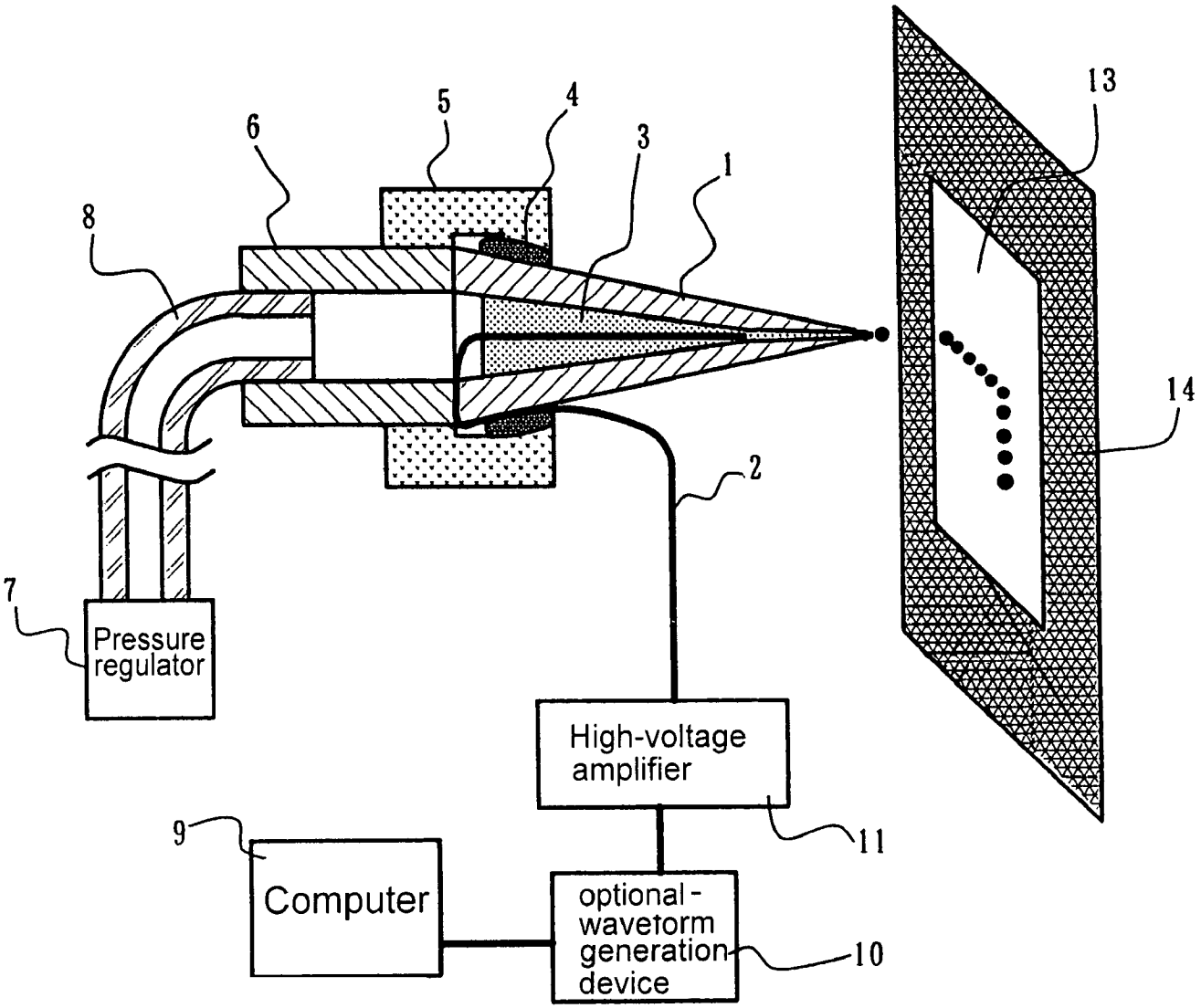
FIG. 9 is an explanatory diagram of an ultrafine fluid jet apparatus according to an embodiment of the present invention.

FIG. 9 shows an ultrafine fluid jet apparatus according to an embodiment of the present invention by a partial sectional view.

Reference numeral 1 in FIG. 9 denotes a nozzle having an ultrafine diameter. In order to realize the size of an ultrafine droplet, a flow passage having a low conductance is preferably arranged near the nozzle 1, or the nozzle 1 itself preferably has a low conductance. For this purpose, a micro capillary tube consisting of glass is preferably used. However, as the material of the nozzle, a conductive material coated with an insulator can also be used. The reasons why the nozzle 1 preferably consists of glass are that a nozzle having a diameter of about several μm can be easily formed, that, when a nozzle is clogged, a new nozzle end can be reproduced by cutting the nozzle end, that, when a glass nozzle is used, the nozzle being tapered, an electric field is easily focused on the distal end of the nozzle and an unnecessary solution moves upward by surface tension and is not retained at the nozzle end not to clog the nozzle, and that a movable nozzle can be easily formed because the nozzle has approximate flexibility. Furthermore, the low conductance is preferably $10^{-10}$ $m^3/s$ or less. Although the shape having a low conductance is not limited to the following shapes, as the shape, for example, a cylindrical flow passage having a small inner diameter, or a flow passage which has an even flow passage diameter and in which a structure serving as a flow resistance is arranged, a flow passage which is curved, or a flow passage having a valve is cited.

For example, the nozzle can be formed by means of capillary puller by using a cored glass tube (GD-1 (product name) available from NARISHIGE CO., LTD.). When the cored glass tube is used, the following effect can be obtained. (1) Since core-side glass is easily wet with ink, ink can be easily filled in the glass tube. (2) Since the core-side glass is hydrophilic, and since the outside glass is hydrophobic, an ink-presence region at the nozzle end is limited to about the inner diameter of the core-side glass, and an electric field concentration effect is more conspicuous. (3) A fine nozzle can be obtained. (4) A sufficient mechanical strength can be obtained.

In the present invention, the lower limit of the nozzle diameter is 0.01 μm simply determined by manufacturing technique. The upper limit of the nozzle diameter is 25 μm on the basis of the upper limit of the nozzle diameter when electrostatic force is stronger than surface tension as shown in FIG. 4 and the upper limit of the nozzle diameter when an ejection condition is satisfied by the local electric field intensity as shown in FIG. 5. The upper limit of the nozzle diameter is preferably 15 μm to effectively perform ejection. In particular, in order to more effectively use a local electric field concentration effect, the nozzle diameter in the range of 0.01 to 8 μm is preferable.

As for the nozzle 1, not only a capillary tube but also a two-dimensional pattern nozzle formed by micropatterning may be used.

When the nozzle 1 consists of glass having good formability, the nozzle cannot be used as an electrode. For this reason, a metal wire (for example, tungsten wire) indicated by reference numeral 2 is inserted into the nozzle 1 as an electrode. An electrode may be formed in the nozzle by plating. When the nozzle 1 itself is formed by a conductive material, an insulator is coated on the nozzle 1.

A solution 3 to be ejected is filled in the nozzle 1. In this case, an electrode 2 is arranged to be dipped in the solution 3. The solution 3 is supplied from a solution source (not shown). As the solution 3, for example, ink or the like is cited.

The nozzle 1 is fixed to a holder 6 by a shield rubber 4 and a nozzle clamp 5 such that pressure is prevented from leaking.

Reference numeral 7 denotes a pressure regulator. Pressure regulated by the pressure regulator 7 is transmitted to the nozzle 1 through a pressure tube 8.

The nozzle, the electrode, the solution, the shield rubber, the nozzle clamp, the holder, and the pressure holder are shown by a sectional side view. A substrate 13 is arranged by a substrate support 14 such that the substrate 13 is close to the distal end of the nozzle.

The role of the pressure regulation device according to the present invention can be used to push a fluid out of the nozzle by applying high pressure to the nozzle. However, rather, the pressure regulating device is particularly effectively used to regulate a conductance, fill a solution in the nozzle, or eliminate clogging of the nozzle. Further, the pressure regulation device is effectively used to control the position of a liquid surface or form a meniscus. As another role of the pressure regulation device, the pressure regulation device gives a differed phase from a voltage pulse and a force acting on the liquid in the nozzle is controlled, thereby controlling a micro ejection rate.

Reference numeral 9 denotes a computer. An ejection signal from the computer 9 is transmitted to an optional-waveform generation device 10 and controlled thereby.

An optional-waveform voltage generated by the optional-waveform generation device 10 is transmitted to the electrode 2 through a high-voltage amplifier 11. The solution 3 in the nozzle 1 is charged by the voltage. In this manner, the focused electric field intensity at the distal end of the nozzle is increased.

In this embodiment, as shown in FIG. 3, an electric field concentration effect at the distal end of the nozzle and image force induced on the counter substrate by charging a fluid droplet by the electric field concentration effect are used. For this reason, unlike a conventional technique, the substrate 13 or the substrate support 14 need not be made conductive, or a voltage need not be applied to the substrate 13 or the substrate support 14. More specifically, as the substrate 13, an insulating glass substrate, a plastic substrate consisting of polyimide or the like, a ceramics substrate, a semiconductor substrate, or the like can be used.

A focused electric field intensity focused on the distal end of the nozzle is increased to decrease the applied voltage.

An applied voltage to the electrode 2 may be plus or minus.

Since the image force strongly acts as the distance between the nozzle 1 and the substrate 13 becomes short as shown in FIG. 7, landing accuracy can be improved. On the other hand, in order to eject a droplet on a substrate having an uneven surface, the nozzle 1 and the substrate 13 must be spaced apart from each other to some extent to prevent the uneven surface from being in contact with the distal end of the nozzle. In consideration of the landing accuracy and the unevenness on the substrate, the distance between the nozzle 1 and the substrate 13 is preferably 500 μm or less, and when the unevenness on the substrate decreases and the landing accuracy is required, the distance is preferably 100 μm or less, more preferably 30 μm or less.

Although not shown, feedback control is performed by detecting a nozzle position to hold the nozzle 1 at a predetermined position with respect to the substrate 13.

The substrate 13 may be held such that the substrate 13 is placed on a conductive or insulating substrate holder.

In this manner, the ultrafine fluid jet apparatus according to the embodiment of the present invention has a simple structure, therefore the ultrafine fluid jet apparatus can easily employ a multi-nozzle structure.

Figure 10:
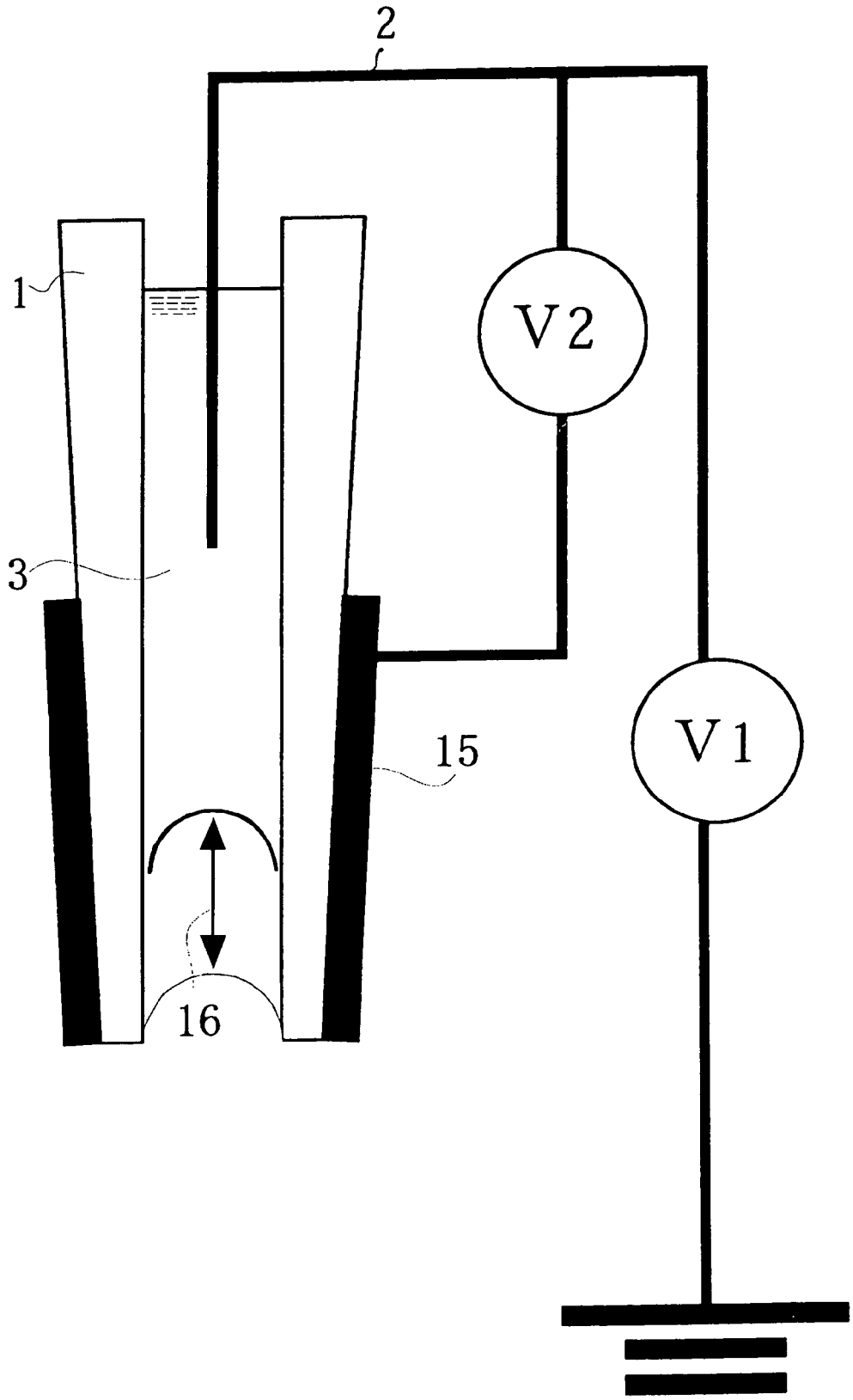
FIG. 10 is an explanatory diagram of an ultrafine fluid jet apparatus according to another embodiment of the present invention.

FIG. 10 shows an ultrafine fluid jet apparatus according to another embodiment of the present invention by using a sectional side central view. An electrode 15 is arranged on a side surface of the nozzle 1, and regulated voltages V1 and V2 are applied through the solution 3 in the nozzle. The electrode 15 is an electrode to control an electrowetting effect. FIG. 10 schematically shows that the distal end of the solution 3 can move by a distance 16 by the electrowetting effect. As described in relation to equation (24), when a sufficient electric field covers the insulator constituting the nozzle, it is expected that an electrowetting effect is achieved without the electrode. However, in this embodiment, control is more actively performed by using the electrode to achieve a role of ejection control. Assuming that the nozzle 1 consists of an insulator and has a thickness of 1 μm, a nozzle inner diameter of 2 μm, and an applied voltage of 300 V, an electrowetting effect of about 30 atm is achieved. Although this pressure is insufficient for ejection, the pressure is significant for ejection from the aspect of supply of a solution to the distal end of the nozzle. Thus, the regulation electrode can control ejection.

Figure 11:
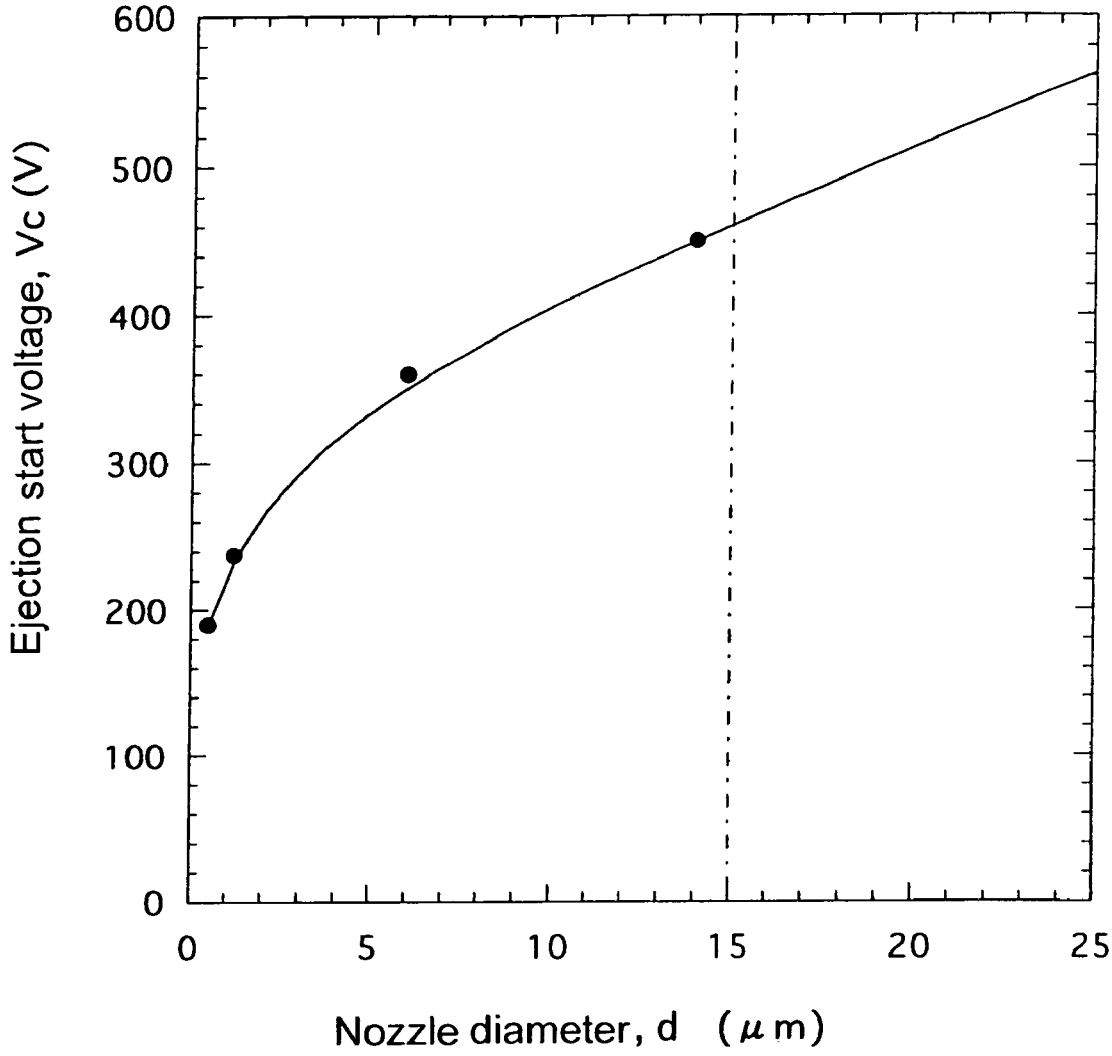
FIG. 11 is a graph showing dependency of ejection start voltage on nozzle diameter according to an embodiment of the present invention.

FIG. 11 shows a dependence of an ejection critical voltage Vc on a nozzle diameter d in an embodiment of the present invention. As a fluid solution, silver nanopaste available from Harima Chemicals, Inc. was used. Measurement was performed at a condition where an inter-nozzle-substrate distance is 100 μm. As the nozzle diameter reduction, the ejection start voltage decreases. It was found that ejection can be performed at a voltage lower than that of a conventional method.

Figure 12:
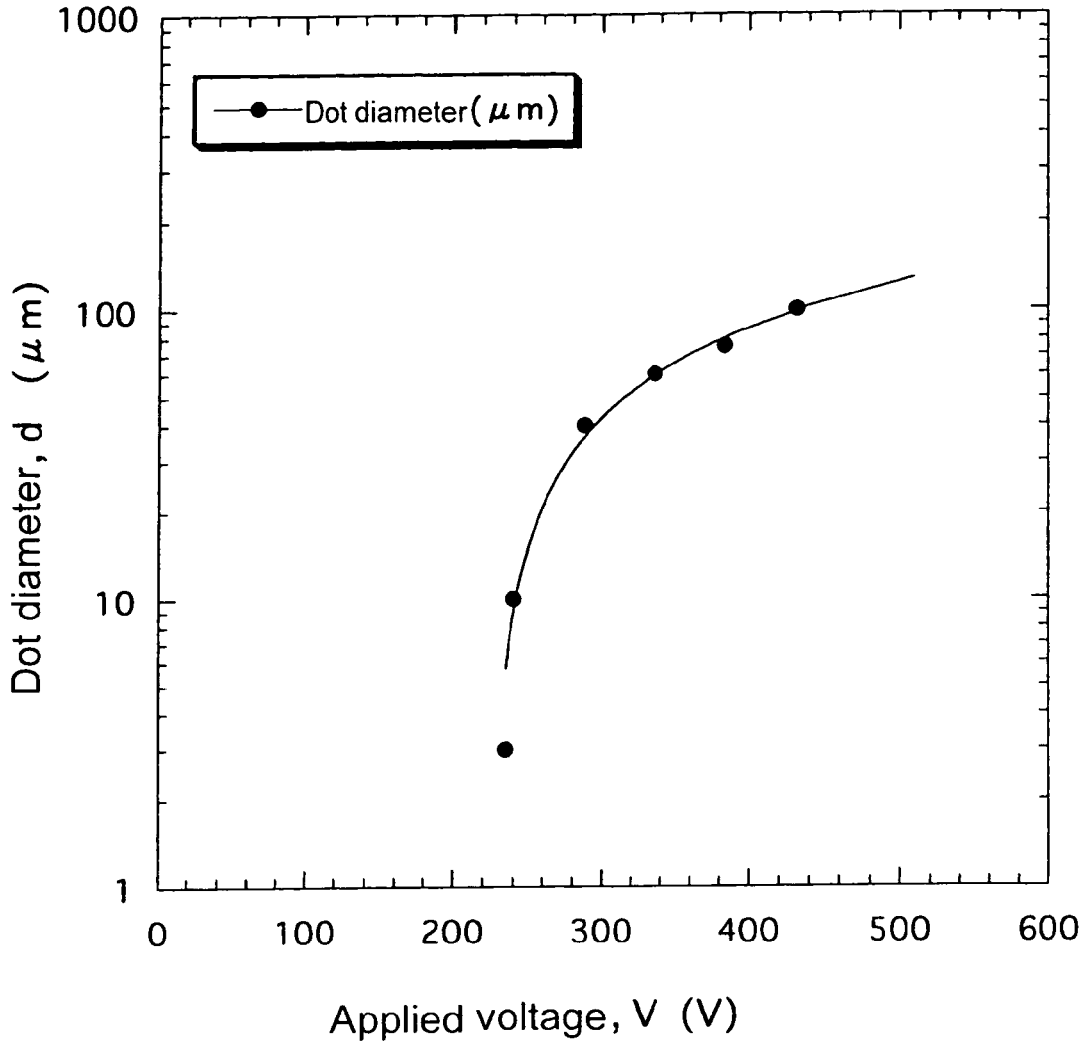
FIG. 12 is a graph showing dependence of print dot diameter on applied voltage according to an embodiment of the present invention.

FIG. 12 shows dependence of a print dot diameter (to also be simply referred to as a diameter hereinafter) on an applied voltage in an embodiment of the present invention. As a print dot diameter d, i.e., a nozzle diameter reductions, a decrease in ejection start voltage V, i.e., driving voltage is apparent. As is apparent from FIG. 12, ejection can be performed at a voltage which is considerably lower than 1000 V, a conspicuous effect comparing with conventional technique was obtained. When a nozzle having a diameter of about 1 μm is used, a significant effect of decrease of the driving voltage to the 200 V level is obtained. These results resolve the conventional problem to decrease driving voltage, and contribute to a decrease in size of the apparatus and an increase in density of the nozzles of the multi-nozzle structure.

Figure 13:
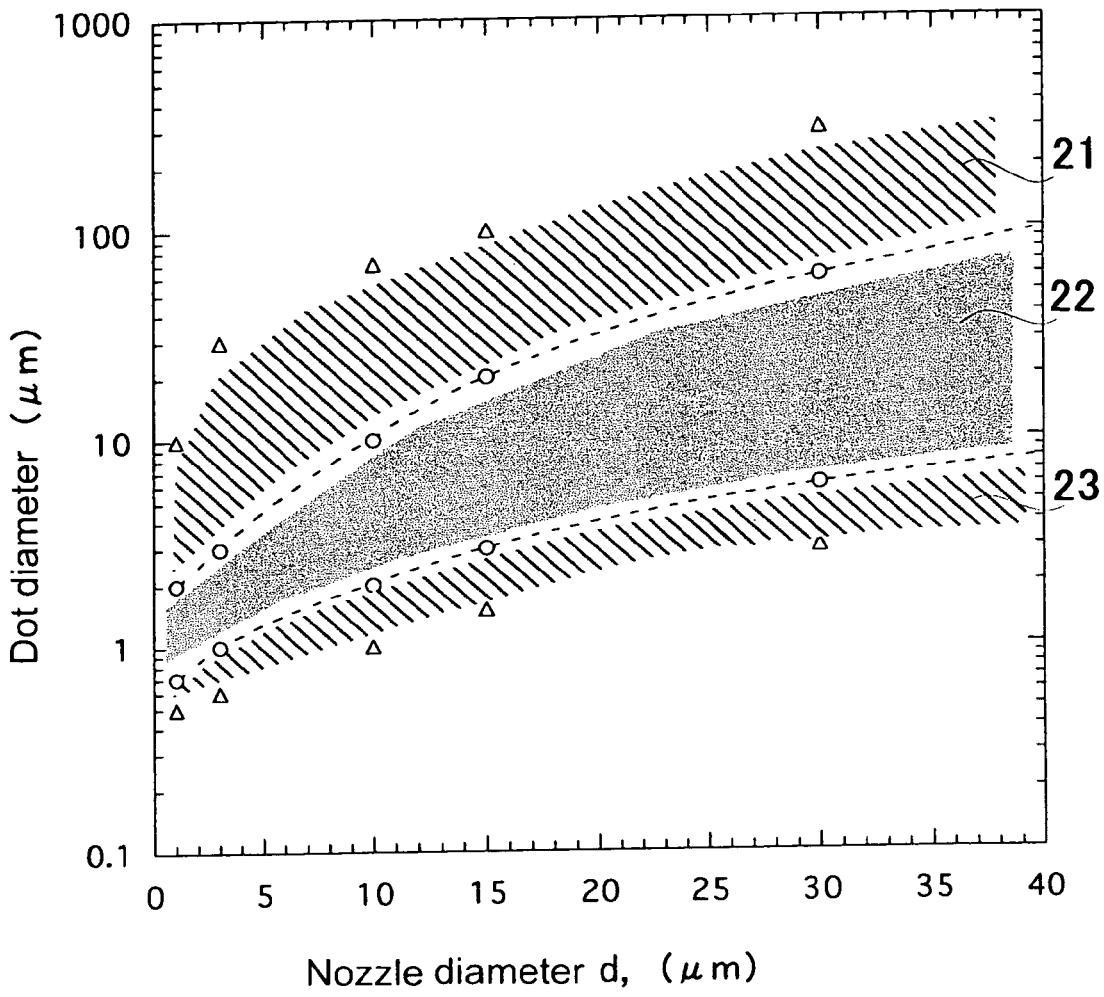
FIG. 13 is a graph showing the correlation of nozzle diameter dependency of print dot diameter according to an embodiment of the present invention.

The dot diameter can be controlled by a voltage. It can also be controlled by regulation of the pulse width of an applied voltage pulse. FIG. 13 shows a correlation between a print dot diameter and a nozzle diameter when a nanopaste is used as ink. Reference numerals 21 and 23 denote possible regions to eject, and reference numeral 22 denotes a preferable region to eject. As is apparent from FIG. 13, a small-diameter nozzle is effectively employed to realize micro-dot printing, and a dot size which is almost equal to or a fraction of the nozzle diameter can be realized by regulating various parameters.

(Operation)

An example of the operation of the apparatus arranged as described above will be described below with reference to FIG. 9.

Since an ultrafine capillary is used as the nozzle 1 having an ultrafine diameter, the liquid level of the solution 3 in the nozzle 1 is positioned inside the distal end face of the nozzle 1 by a capillary phenomenon. Therefore, in order to make ejection of the solution 3 easy, the pressure regulator 7 is used to put hydrostatic pressure on the pressure tube 8, and the liquid level is regulated such that the liquid level is positioned near the distal end of the nozzle. The pressure used at this time depends on the shape of the nozzle or the like, and may not be put. However, in consideration of a decrease in driving voltage and an increase in responsive frequency, the pressure is about 0.1 to 1 MPa. When a pressure is excessively put, the solution overflows from the distal end of the nozzle. However, since the shape of the nozzle is tapered, due to the operation of surface tension, the excessive solution is not stopped at the nozzle end, and rapidly moves to the holder side. For this reason, a cause of fixation of the solution at the distal end of the nozzle, i.e., clogging of the nozzle can be reduced.

In the optional-waveform generation device 10, a current having a DC, pulse, or AC waveform is generated on the basis of an ejection signal from the computer 9. For example, in ejection of a nanopaste, a waveform such as a single pulse, an AC continuous wave, a direct current, an AC+DC bias, or the like can be used, although not limited to these waveforms.

A case in which an AC waveform is used will be explained.

An AC signal (rectangular wave, square wave, sine wave, sawtooth wave, triangular wave, or the like) is generated by the optional-waveform generation device 10 on the basis of an ejection signal from the computer 9, and the solution is ejected at a frequency which is a critical frequency fc or lower.

Conditions of solution ejection are functions of an inter-nozzle-substrate distance (L), an amplitude (V) of an applied voltage, an applied voltage frequency (f). The ejection conditions must satisfy certain conditions, respectively. In contrast to this, when any one of these conditions is not satisfied, another parameter needs to be changed.

This will be described below with reference to FIG. 14.

For ejection, a predetermined critical electric field Ec 26 exists. Ejection does not occur in an electric field lower than the critical electric field Ec 26. This critical electric field is a value which changes depending on the nozzle diameter, a surface tension of the solution, the viscosity of the solution, and the like. Ejection can hardly performed in an electric field which is equal to or lower than an electric field Ec. In an electric field which is equal to or higher than the critical electric field Ec, i.e., at a possible electric field intensity to eject, the inter-nozzle-substrate distance (L) and the amplitude (V) of the applied voltage are almost proportional to each other. When the inter-nozzle distance is shortened, a critical applied voltage V can be decreased.

In contrast to this, when the inter-nozzle-substrate distance L is made extremely large, and when the applied voltage V is increased, even if the electric field intensity is kept constant, a fluid droplet is blown out, i.e., burst in a corona discharge region 24 due to an operation of corona discharge or the like. For this reason, in order to position the nozzle in a preferable-ejection region to eject 25 in which preferable ejection characteristics can be obtained, the distance must be appropriately kept. In consideration of the landing accuracy and the unevenness of the substrate as described above, the inter-nozzle-substrate distance is preferably suppressed to 500 μm or less.

The distance being kept constant, the voltage V1 and V2 are set to traverse a critical electric field boundary Ec, and voltages are switched, so that ejection of fluid droplet can be controlled.

Figure 14:
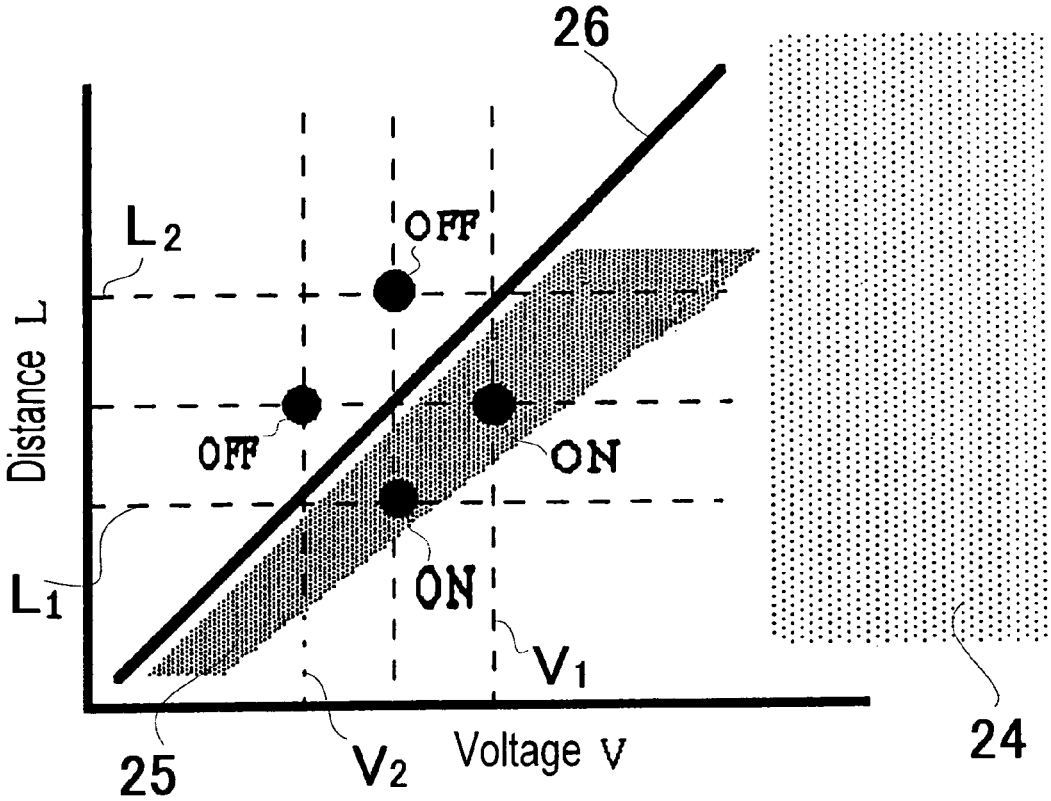
FIG. 14 is a diagram explaining the ejection condition obtained by distance-voltage relation in an ultrafine fluid jet apparatus according to an embodiment of the present invention.
Figure 15:
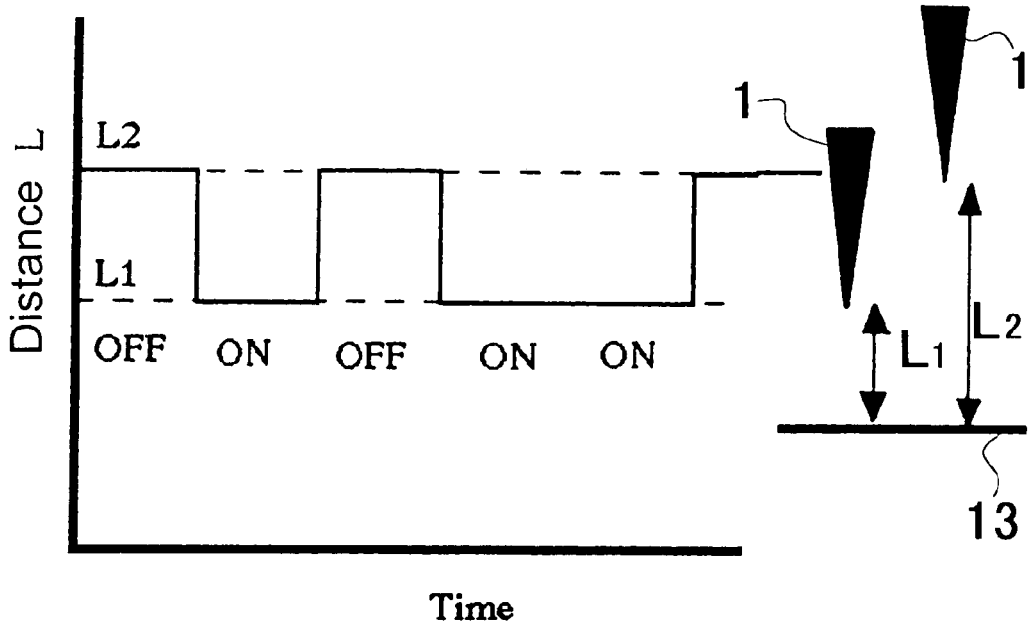
FIG. 15 is a diagram explaining the ejection condition obtained by distance control in an ultrafine fluid jet apparatus according to an embodiment of the present invention.

The voltage being kept constant, distances L1 and L2 are set as shown in FIG. 14, and a distance from the nozzle 1 to the substrate 13 is controlled as shown in FIG. 15, so that an electric field applied to the fluid droplet can be changed and controlled.

Figure 16:
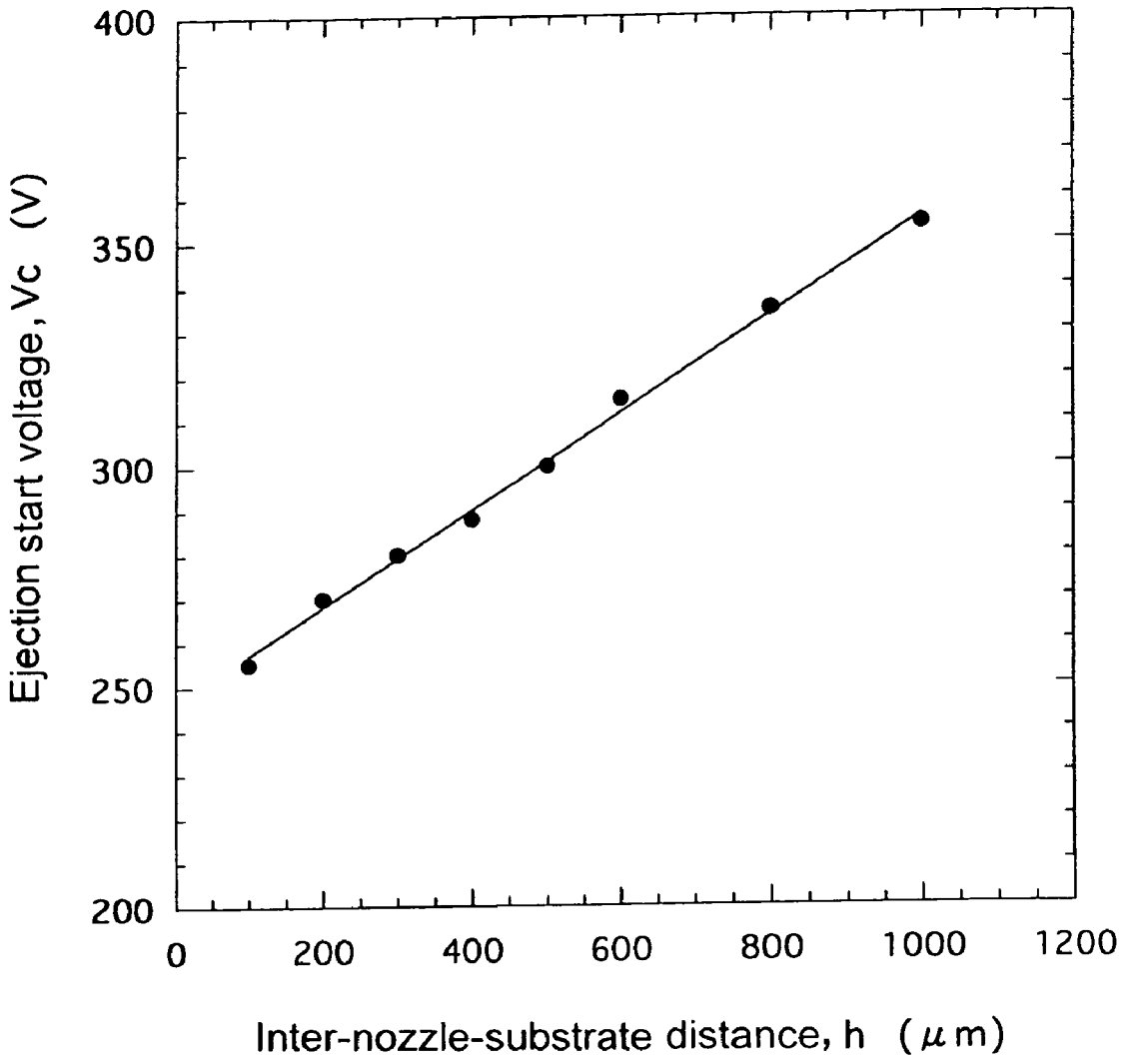
FIG. 16 is a graph showing dependency of ejection start voltage on inter-nozzle-substrate distance according to an embodiment of the present invention.

FIG. 16 is a graph showing an ejection start voltage dependence on an inter-nozzle-substrate distance in an embodiment of the present invention. In this embodiment, as an ejection fluid, silver nanopaste available from Harima Chemicals, Inc. was used. Measurement is performed at a condition where a nozzle diameter is 2 μm. As is apparent from FIG. 16, the ejection start voltage increases with an increase in inter-nozzle-substrate distance. As a result, for example, while an applied voltage is kept constant at 280 V, when the inter-nozzle-substrate distance is changed from 200 μm to 500 μm, the value traverses an ejection limit line. For this reason, the start/stop of ejection can be controlled.

The case in which any one of the distance and the voltage is fixed has been described above. However, when the distance and the voltage are simultaneously controlled, ejection can also be controlled.

Figure 17:
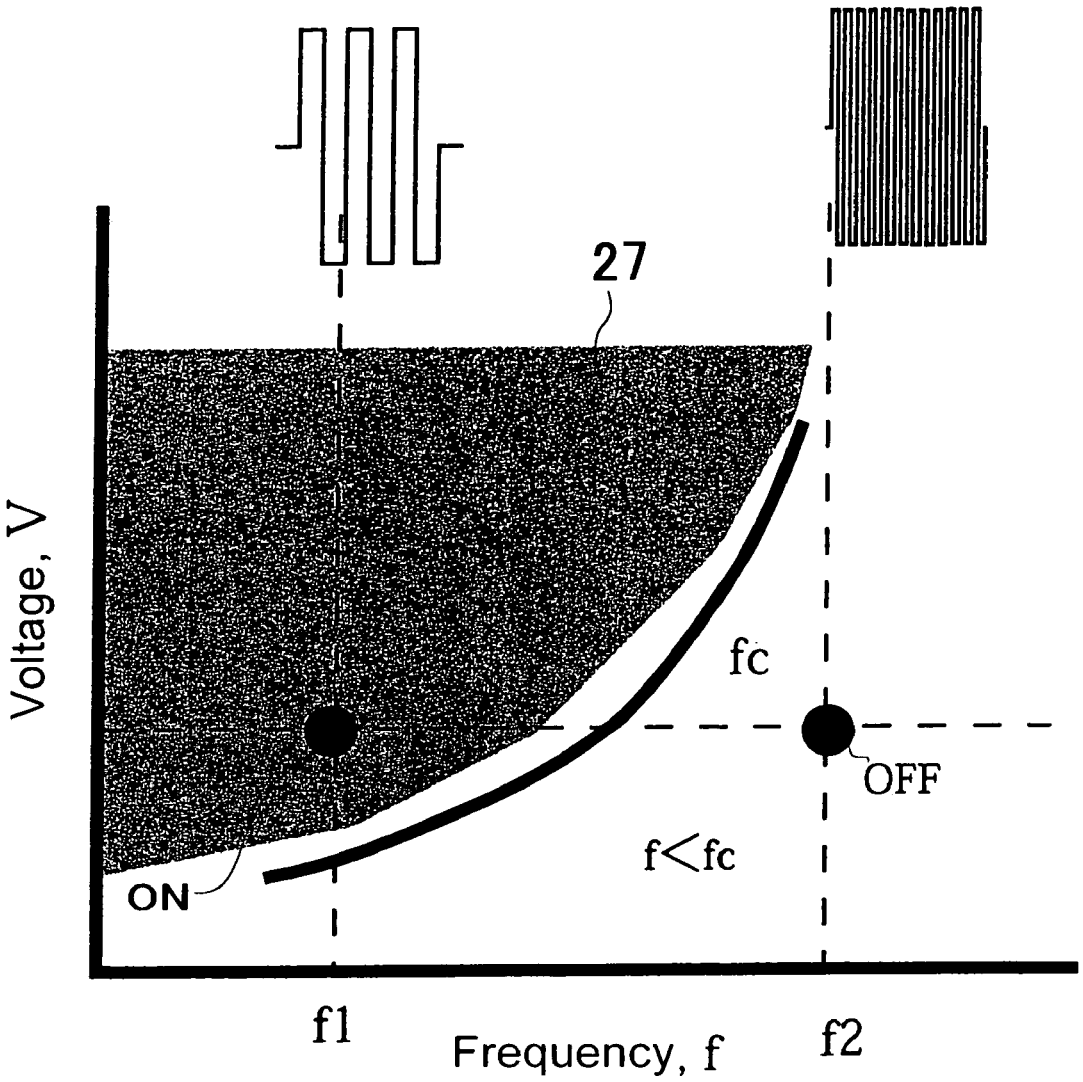
FIG. 17 is a diagram explaining the ejection condition obtained by distance-frequency relationship in an ultrafine fluid jet apparatus according to an embodiment of the present invention.

In a state in which these conditions are satisfied, for example, a square wave is generated by the optional-waveform generation device 10, and the frequency of the square wave is continuously changed. In this case, there is a certain critical vibration fc. It was found that ejection did not occur at a frequency which is equal to or higher than fc. This manner is shown in FIG. 17.

The frequencies include a certain critical frequency. The critical frequency is a value depending on not only an amplitude voltage and an inter-nozzle-substrate distance, but also a nozzle diameter, the surface tension of a solution, the viscosity of the solution, and the like. At a certain inter-nozzle-substrate distance L, when a frequency having a constant amplitude and a continuous square waveform is changed as indicated by f1 and f2 in FIG. 17, the value moves from a preferable-ejection region 27 in which f<fc is satisfied to an impossible-ejection region in which f>fc is satisfied. For this reason, ejection control can be performed.

Figure 18:
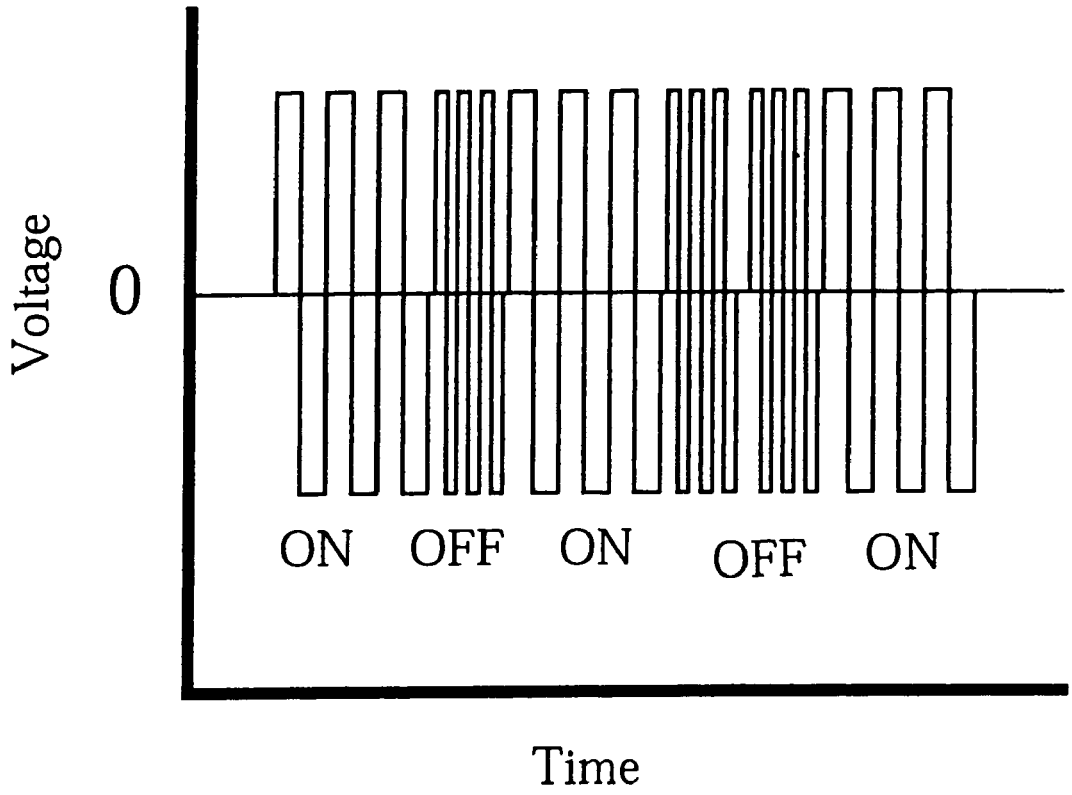
FIG. 18 is an AC voltage control pattern diagram in an ultrafine fluid jet apparatus according to an embodiment of the present invention.

As shown in FIG. 18, a vibrating electric field having an amplitude equal to an amplitude in an ON state is applied to the solution in an OFF state, so that the liquid surface is vibrated to aid prevention of clogging of the nozzle.

As described above, changing any one of the three parameters, the inter-nozzle-substrate distance L, the voltage V, and the frequency f makes it possible to perform ON/OFF control.

Figure 19:
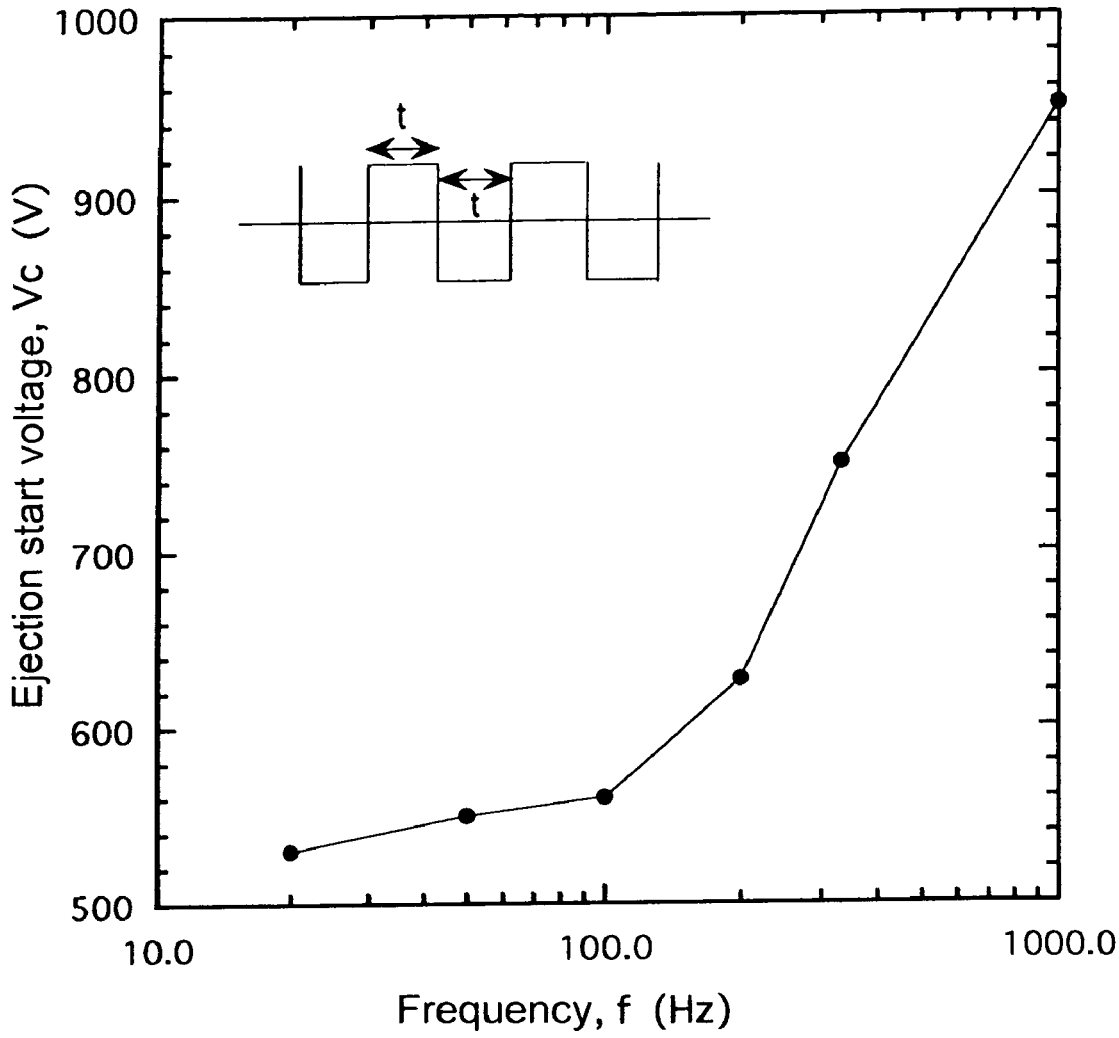
FIG. 19 is a graph showing dependency of ejection start voltage on frequency according to an embodiment of the present invention.

FIG. 19 is a graph showing dependence of an ejection start voltage on a frequency in still another embodiment of the present invention. In this embodiment, as an ejection fluid, silver nanopaste available from Harima Chemicals, Inc. was used. A nozzle used in an experiment consists of glass, and a nozzle diameter is about 2 μm. When an AC voltage having a square waveform is applied, an ejection start voltage, which is about 530 V in peak to peak at first, at a frequency of 20 Hz, gradually increases with an increase in frequency. For this reason, in this embodiment, when an applied voltage is kept constant at 600 V, for example, and the frequency is changed from 100 Hz to 1 kHz, the value traverses an ejection start voltage line. For this reason, the ejection can be changed from an ON state to an OFF state. That is, ejection control can be performed by modulation of the frequency. At this time, when actual print results are compared with each other, time responsiveness is better in the frequency modulation scheme than in control by changing an applied voltage, i.e., an amplitude control scheme. In particular, a conspicuous effect which can obtain a preferable print result at a restart of ejection after a pause is apparent. It is considered that such frequency responsiveness is related to time responsiveness to charging of a fluid, i.e., dielectric response:

$$\tau = \frac{\varepsilon}{\sigma} \tag{20}$$

wherein $\tau$ is a dielectric relaxation time (sec), $\in$ is a specific inductive capacity of the fluid, and $\sigma$ is a conductivity ($S \cdot m^{-1}$) of the fluid. In order to achieve high responsiveness, it is effective to decrease the dielectric constant of the fluid and increase the conductivity of the fluid. In AC drive, since a solution positively charged and a solution negatively charged can be alternately ejected, an influence by accumulation of charges on the substrate, especially, in use of an insulating substrate can be minimized. Thus, landing position accuracy and ejection controllability was improved.

Figure 20:
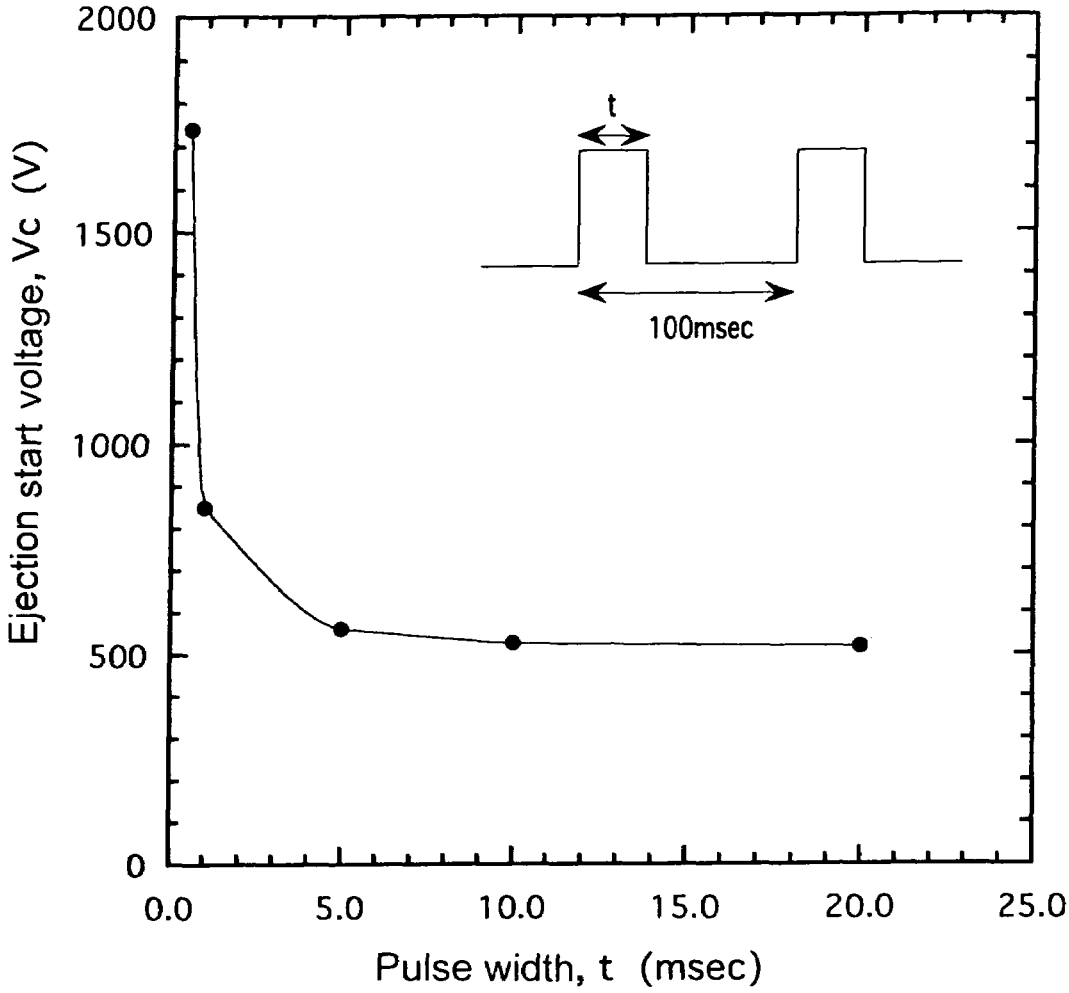
FIG. 20 is a graph showing dependency of ejection start voltage on pulse width according to an embodiment of the present invention.

FIG. 20 shows an ejection start voltage dependency on a pulse width in an embodiment of the present invention. A nozzle consists of glass, and a nozzle inner diameter is about 6 μm. As a fluid, silver nanopaste available from Harima Chemicals, Inc. was used. An experiment was performed by using a square pulse at a pulse frequency of 10 Hz. As is apparent from FIG. 20, an increase in ejection start voltage becomes conspicuous at a pulse width of 5 msec or less. For this reason, it is understood that a relaxation time $\tau$ of the silver nanopaste is about 5 msec. In order to improve responsiveness of ejection, it is effective to increase the conductivity of the fluid and decrease the dielectric constant of the fluid.

(Prevention, Relief of Clogging)

As for cleaning of the distal end of the nozzle 1, a method of putting a high pressure in the nozzle 1 and bring the substrate 13 into contact with the distal end of the nozzle 1 to rub solidified solution against the substrate 13, or to bring the solidified solution into contact with the substrate 13 to use capillary force acting on a small interval between the nozzle 1 and the substrate 13 is applied.

The nozzle 1 is dipped in a solvent before the solution is filled in the nozzle 1 to fill a slight amount of solvent in the nozzle 1 by capillary force, so that the clogging of the nozzle at the start can be prevented. Further, when the nozzle is clogged during printing operation, the clogging can be relieved by dipping the nozzle in the solvent.

It is also effective to dip the nozzle 1 in a solvent dropped on the substrate 13, and, at the same time, to apply a pressure, a voltage, and the like.

The above measures are generally effective in the case of a solvent having a low vapor pressure and a high boiling point, e.g., xylene or the like although it is not always effective depending on the types of solutions to be used.

As will be described later, when an AC drive method is used as a voltage applying method, a stirring effect is given to the solution in the nozzle to keep homogeneity of the solution. Further, when the charging properties of the solvent and a solute are widely different from each other, clogging of the nozzle can be relieved by alternate ejection of a droplet of a solvent excessive and a droplet of a solute excessive, as compared to an average composition of the solution. When the charging characteristics, polarities, and pulse widths of the solvent and the solute were optimized in accordance with the nature of the solution, a change in composition with time can be minimized, and stable ejection characteristics could be maintained for a long period of time.

(Drawing Position Regulation)

It is practical that a substrate holder is arranged on an X-Y-Z stage to operate the position of the substrate 13. However, another configuration can be applied. In contrast to the above configuration, the nozzle 1 can also be arranged on the X-Y-Z stage.

An inter-nozzle-substrate distance is regulated to an appropriate distance by using a fine position adjusting device.

In the position regulation of the nozzle, a Z-axis stage is moved by closed loop control on the basis of distance data obtained by a laser micrometer, and the nozzle position can be kept constant at an accuracy of 1 μm or less.

(Scanning Method)

In a conventional raster scan scheme, at a step for forming a continuous line, circuit pattern may be disconnected due to a lack of landing position accuracy, defective ejection, or the like. For this reason, in this embodiment, in addition to the raster scan scheme, a vector scan scheme is employed. It is described in, e.g., S. B. Fuller et al., Journal of Microelectromechanical systems, Vol. 11, No. 1, p. 54 (2002) that circuit drawing is performed by vector scanning using a single-nozzle inkjet.

In raster scanning, new control software which was developed to interactively designate a drawing position on a computer screen was used. In the case of vector scanning, when a vector data file is loaded, complex pattern drawing can be automatically performed. As the raster scan scheme, a scheme which is performed in a conventional printer can be properly used. As the vector scan scheme, a scheme used in a conventional plotter can be properly used.

For example, as a stage to be used, SGSP-20-35 (XY) available from SIGMA KOKI CO., LTD. and Mark-204 controller are used. As control software, software is self-produced by using Labview available from National Instruments Corporation. A case in which the moving speed of the stage is regulated within the range of 1 μm/sec to 1 mm/sec to obtain the most preferable drawing will be considered below. Here, in the case of the raster scanning, the stage is moved at a pitch of 1 μm to 100 μm, and ejection can be performed by a voltage pulse, linking with the movement of the stage. In the case of the vector scanning, the stage can be continuously moved on the basis of vector data. As a substrate used here, a substrate consisting of glass, metal (copper, stainless steel, or the like), semiconductor (silicon), polyimide, polyethylene phthalate, and the like are cited.

(Control of Substrate Surface State)

When metal ultrafine particles (for example; nanopaste available from Harima Chemicals, Inc.) or the like are to be patterned conventionally on polyimide, the pattern by nanoparticles are broken due to the hydrophilicity of the polyamide, which causes an obstacle to patterning of micro thin lines. A similar problem is also posed when another substrate is used.

In order to avoid such a problem, for example, a method of performing a process of using the interface energy, e.g., a fluorine plasma process or the like and patterning a hydrophilic region, a hydrophobic region, and the like on a substrate in advance is conventionally performed.

However, in this method, a patterning process must be performed on the substrate in advance, the precious merit of the inkjet method which is a direct circuit forming method cannot be completely utilized.

Therefore, in this embodiment, a new polyvinylphenol (PVP) ethanol solution is thinly, uniformly spin-coated on the substrate to form a surface-modify layer, thereby solving the conventional problem. The PVP can be dissolved in a solvent (tetradecan) of a nanopaste. For this reason, when the nanopaste is processed in an inkjet, the solvent of the nanopaste corrodes the PVP layer of the surface-modified layer, and the solvent is neatly stabilized without spreading at a landing position. After the nanopaste is processed in an inkjet, a solution is evapolated at a temperature of about 200° C. and sintered, so that the nanopaste can be used as a metal electrode. The surface-modifying method according to the embodiment of the present invention is not affected by the heat treatment, and does not adversely affect the nanopaste (i.e., electric conductivity).

(Example of Drawing by Ultrafine Fluid Jet Apparatus)

Figure 21:
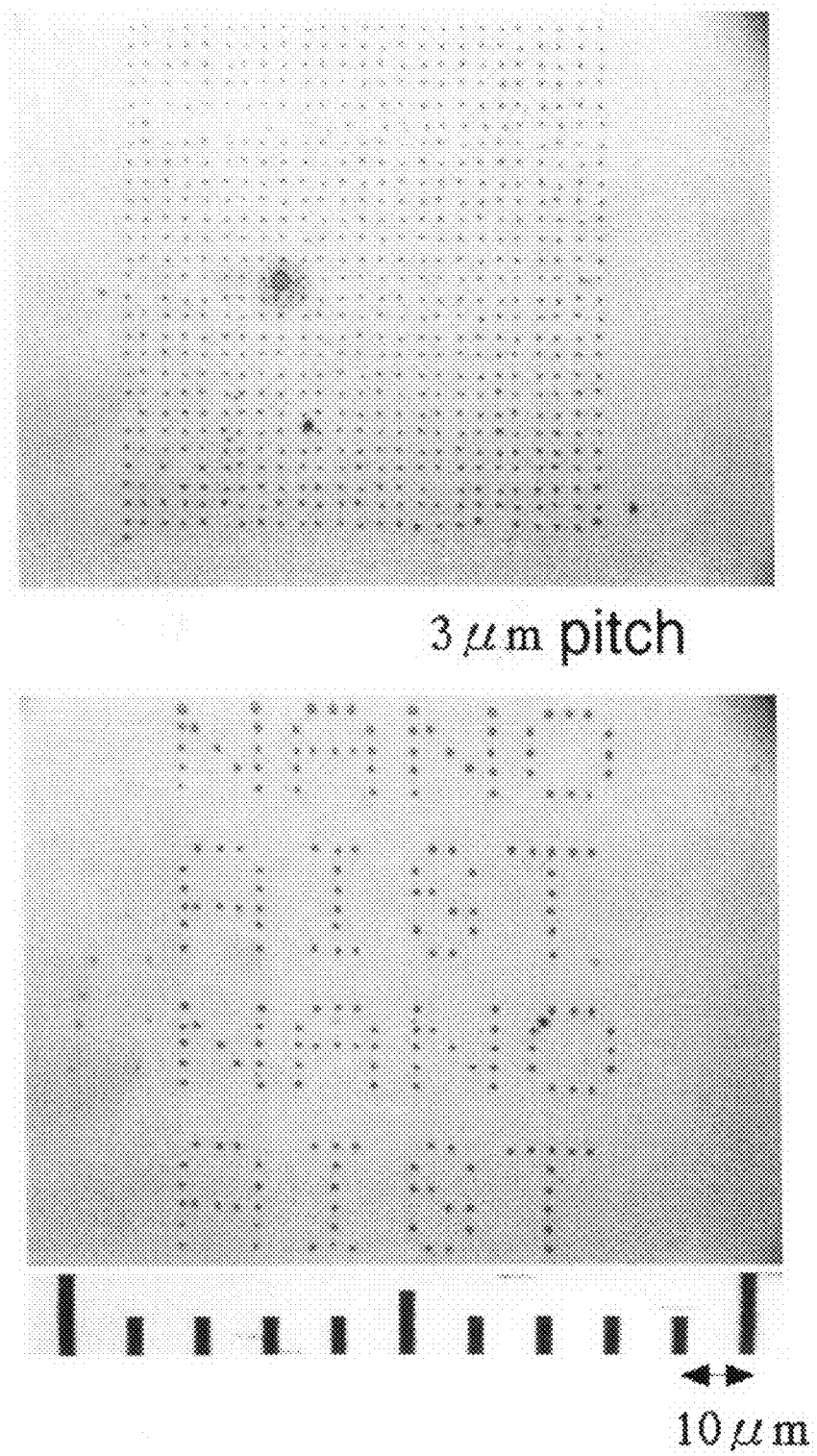
FIG. 21 is a photograph showing an example of ultrafine dot formation performed by an ultrafine fluid jet apparatus according to the present invention.

FIG. 21 shows an example of ultrafine dot formation performed by the ultrafine fluid jet apparatus according to the present invention. In FIG. 21, an aqueous solution of fluorescent dye molecules is arranged on a silicon substrate, and printing is performed at intervals of 3 μm. The lower portion in FIG. 21 indicates an index of size in the same scale as above. A large scale mark indicates 100 μm, and a small scale mark indicates 10 μm. Fine dots each having a size of 1 μm or loss, i.e., submicron could be regularly aligned. In details, although intervals between some dots are not uniform, the intervals depend on mechanical accuracy of a backrush or the like of a stage used for positioning. Since a droplet realized by the present invention is an ultrafine droplet, the droplet is evaporated just at the moment the droplet lands on the substrate, although depending on the types of solvents to be used as ink, and the droplet is instantaneously fixed at the position. The drying rate in this example is far higher than that of a droplet having a size of several tens of μm generated in a conventional technique. This is because a vapor pressure is made remarkably high by miniaturization and precision of a droplet. In conventional technique using a piezo scheme or the like, a fine dot having a size equal to that of the present invention cannot be easily formed, and landing accuracy is poor. For this reason, for a countermeasure, hydrophilic patterning and hydrophobic patterning are performed on the substrate in advance (for example, H. Shiringhaus et al., Science, Vol. 290, 15 Dec. (2000), 2123-2126). According to this method, since a preparatory process is necessary, the inkjet scheme loses its advantage that printing can be directly performed on the substrate. However, when such a method is also used in the present invention, the position accuracy can also be more improved.

Figure 22:
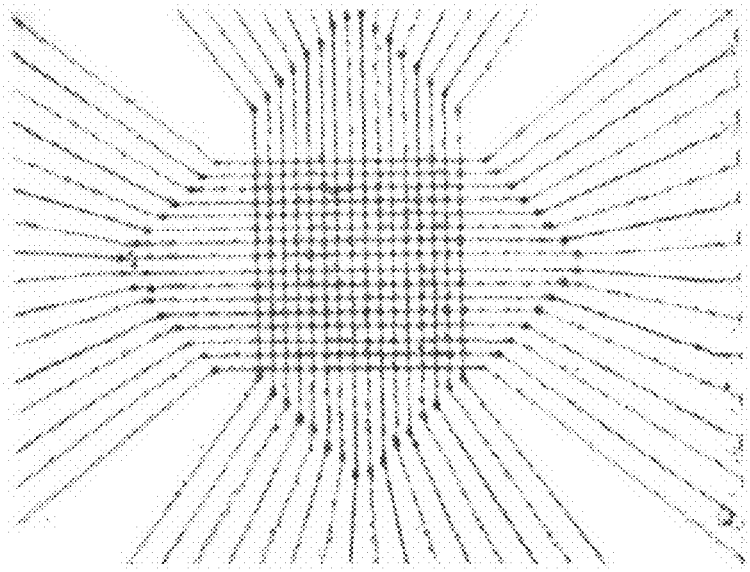
FIG. 22 is a photograph showing an example of a drawing of a circuit pattern obtained by an ultrafine fluid jet apparatus according to the present invention.

FIG. 22 shows an example of drawing of a circuit pattern performed by the ultrafine fluid jet apparatus according to the present invention. In this case, as a solution, MEH-PPV serving as a soluble derivative of polyparaphenylenevinylene (PPV) which is a typical conductive polymer was used. A line width is about 3 μm, and drawing is performed at intervals of 10 μm. The thickness is about 300 nm. The drawing itself of a circuit pattern using the fluid jet apparatus is described in, for example, H. Shiringhaus et al., Science, Vol. 280, p. 2123 (2000), or Tatsuya Shimoda, Material stage, Vol. 2, No. 8, p. 19 (2002).

Figure 23:
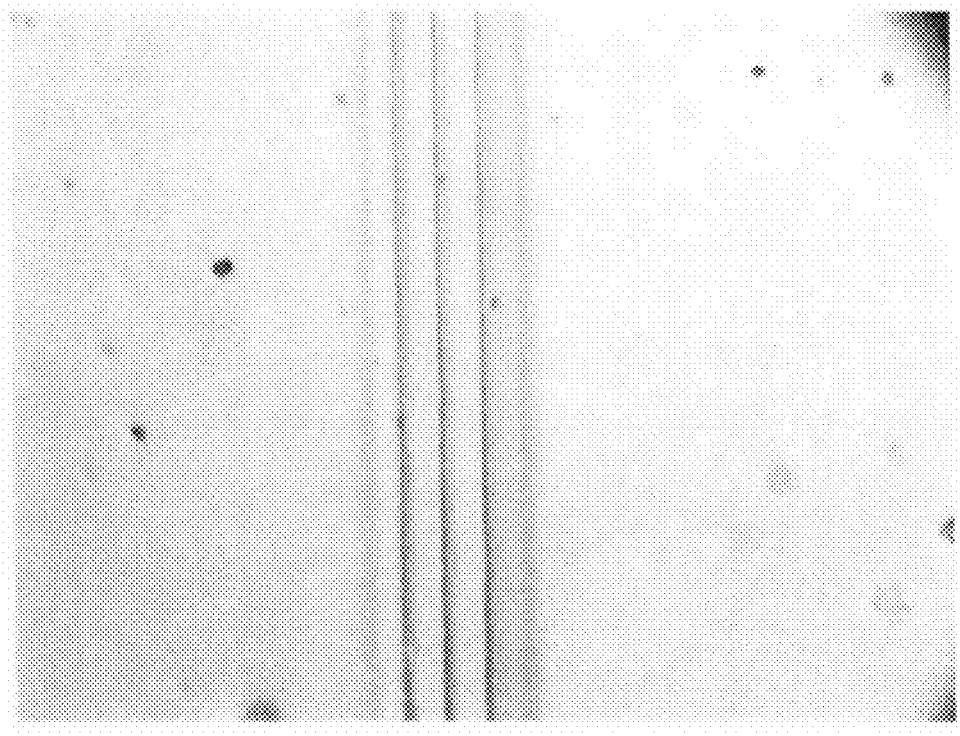
FIG. 23 is a photograph showing an example of circuit pattern formation using metal ultrafine particles obtained by an ultrafine fluid jet apparatus according to the present invention.

FIG. 23 shows an example of circuit pattern formation using metal ultrafine particles by the ultrafine fluid jet apparatus according to the present invention. Drawing itself of a line using a nanopaste is described in, for example, Ryoichi Oohigashi et al., Material stage, Vol. 2, No. 8, p. 12 (2002). Silver ultrafine particles (nanopaste: Harima Chemicals, Inc.) are used as a solution, and drawing is performed with a line width of 3.5 μm and at intervals of 1.5 μm. The nanopaste is obtained by adding a special additive to independent dispersion metal ultrafine particles each having a particle diameter of several nm. The particles do not bond each other at room temperature. However, when the temperature is slightly increased, the particles are sintered at a temperature which is considerably lower than the melting point of the constituent metal. After the drawing, the substrate was subjected to heat treatment at a temperature of about 200° C., a pattern constituted by silver thin lines was formed, and good conductivity was confirmed.

Figure 24:
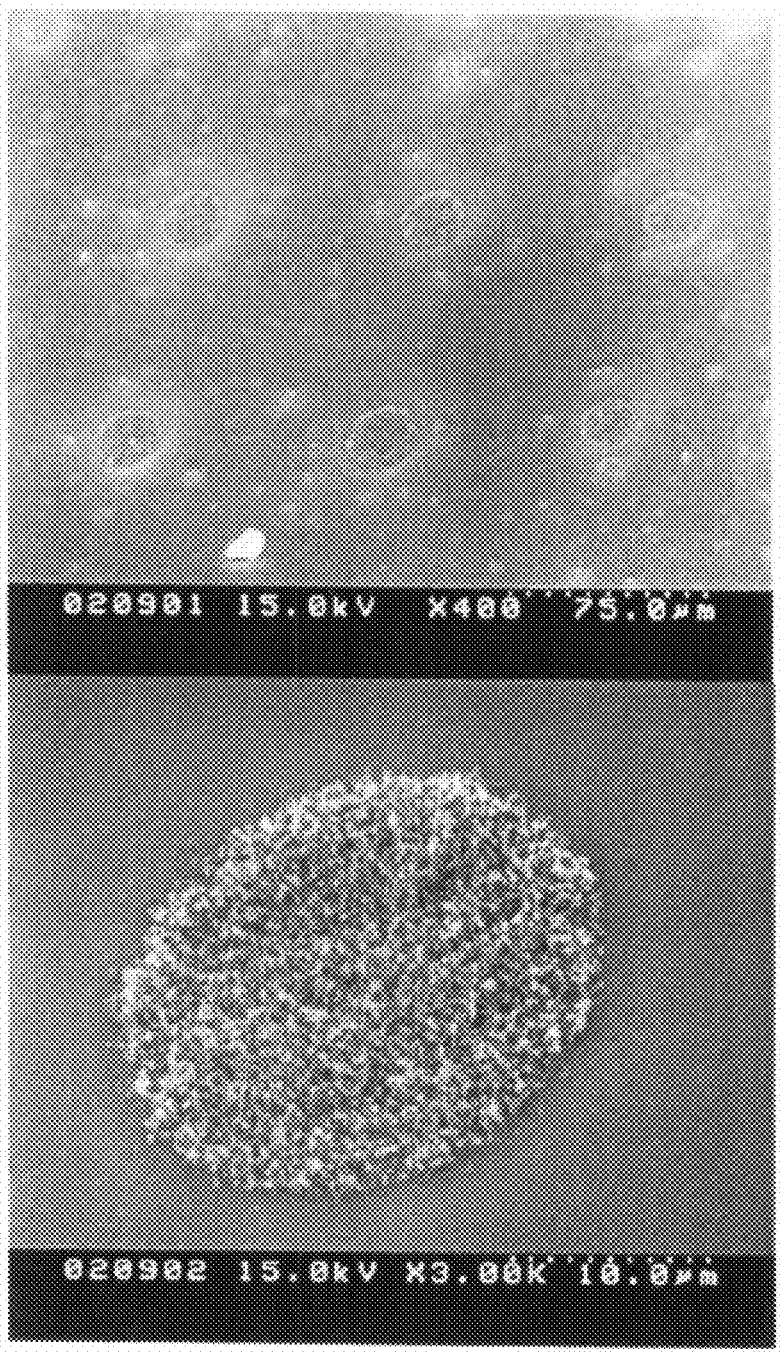
FIG. 24 includes photographs showing an example of carbon nanotubes, a precursor thereof, and a catalytic alignment that are obtained by an ultrafine fluid jet apparatus according to the present invention.

FIG. 24 shows examples of carbon nanotubes, a precursor thereof, and a catalytic alignment which are obtained by the ultrafine fluid jet apparatus according to the present invention. Formation itself of the carbon nanotubes, the precursor thereof, and the catalytic alignment using the fluid jet apparatus is described in H. Ago et al., Applied Physics Letters, Vol. 82, p. 811 (2003). The carbon nanotube catalyst is obtained by dispersing ultrafine particles consisting of transition metals such as iron, cobalt, and nickel in an organic solvent by using a surfactant. A solution containing a transition metal, e.g., a solution of ferric chloride or the like can be similarly treated. The catalyst is drawn with a dot diameter of about 20 μm at intervals of 75 μm. After the drawing, according to a common procedure, the solution was reacted in a flow of a gas mixture of acetylene and an inert gas to selectively generate carbon nanotubes at a corresponding portion. Since such a nanotube array is excellent in electron-emission characteristic, the nanotube array may be applied to an electron beam of a field-emission display, an electronic component, and the like.

Figure 25:
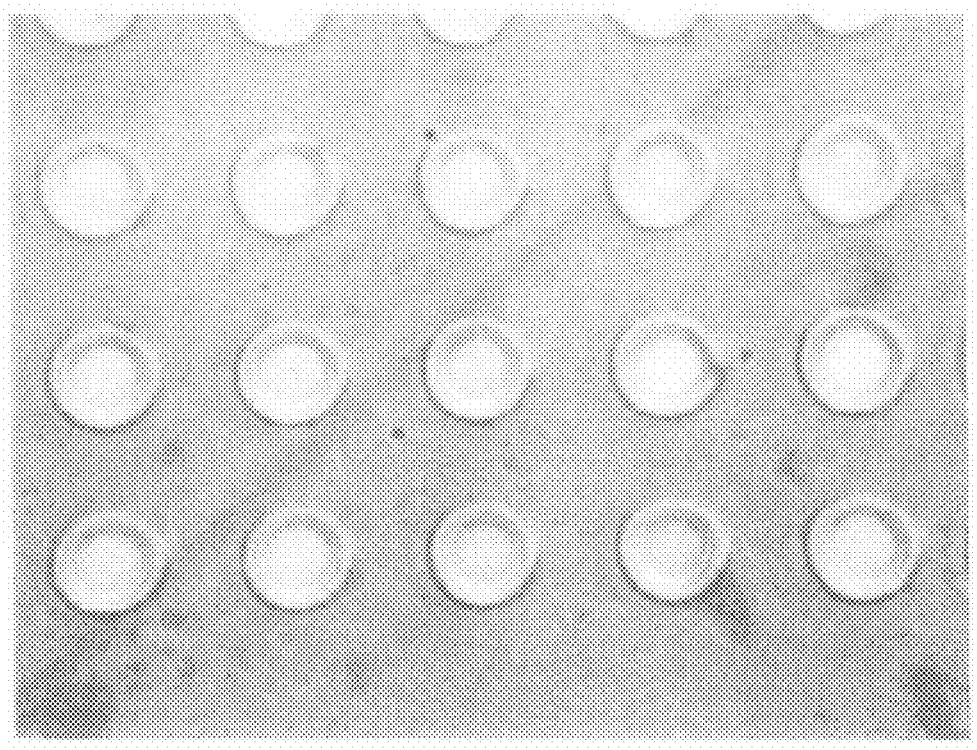
FIG. 25 is a photograph showing an example of patterning of ferroelectric ceramics and a precursor thereof that are obtained by an ultrafine fluid jet apparatus according to the present invention.

FIG. 25 shows an example of patterning of ferroelectric ceramics and a precursor thereof by the ultrafine fluid jet apparatus according to the present invention. As a solvent, 2-methoxyethanol is used. Drawing is performed with dot diameter of 50 μm, and at intervals of 100 μm. Dots could be aligned in the pattern of a grating by raster scanning, and a triangular grating or a hexagonal grating could be drawn by vector scanning. When a voltage and a waveform is regulated, dots each having a diameter of 2 μm to 50 μm or a micro pattern having a length of 15 μm in one side and a thickness of 5 μm could be obtained.

When the kinetic energy or the like of a fluid droplet is controlled, a three-dimensional structure as shown in FIG. 25 can be formed. The three-dimensional structure can be applied to an actuator, a memory array, or the like.

Figure 26:
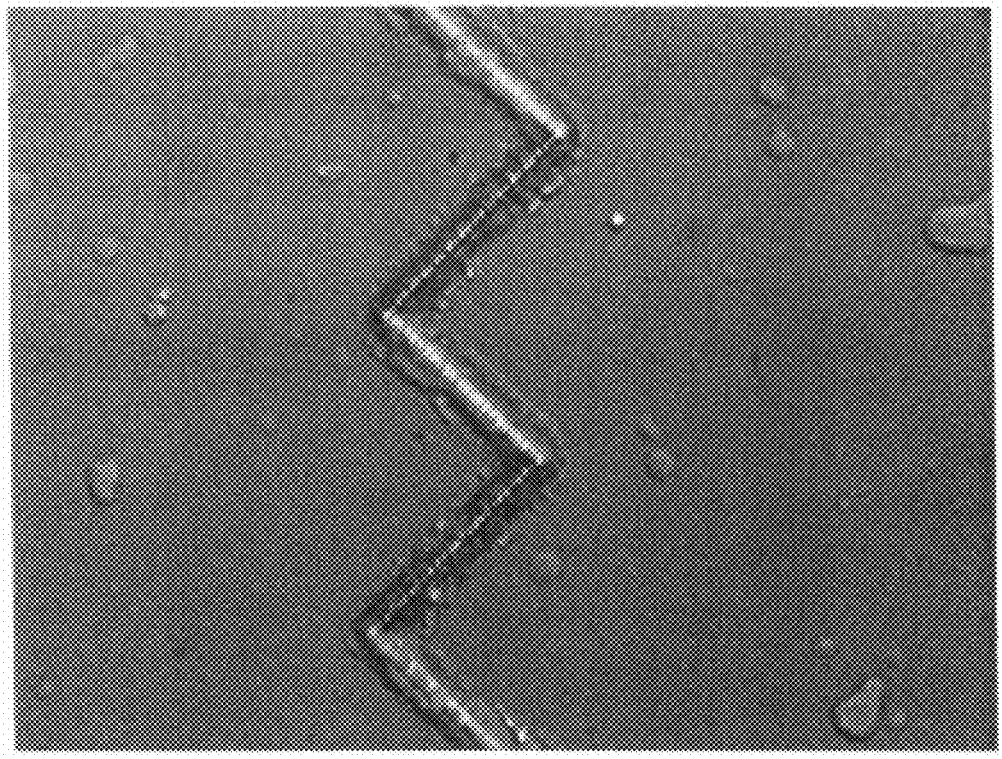
FIG. 26 is a photograph showing an example of high-degree alignment of a polymer and a precursor thereof, which are obtained by an ultrafine fluid jet apparatus according to the present invention.

FIG. 26 shows an example of high-degree alignment of a polymer performed by the ultrafine fluid jet apparatus according to the present invention. As a solution, MEH-PPV (poly [2-methoxy-5-(2'-ethyl-hexyloxy)]-1,4-phenylenevinylene) serving a soluble derivative of polyparaphenylenevinylene (PPV) which is a typical conductive polymer was used. Drawing is performed with a line width of 3 μm. The thickness is about 300 nm. The photograph is obtained by a polarizing microscope. Photographing is performed thruogh crossed Nicols. A difference in brightness among crossing patterns indicates that molecules aligned along the direction of line. As a conductive polymer, in addition to the above polymer, P3HT (poly(3-hexylthiophene)), RO-PPV, a polyfluorene derivative, or the like can be used. Precursors of these conductive polymers can be similarly aligned. The patterned organic molecules can be used as an organic electronic element, an organic circuit patterning, an optical waveguide, or the like. Patterning itself of a conductive polymer is described in, for example, Kazuhiro Murata, Material stage, Vol. 2, No.

8, p. 23 (2002), K. Murata and H. Yokoyama, Proceedings of the ninth international display workshops, (2002), p. 445.

Figure 27:
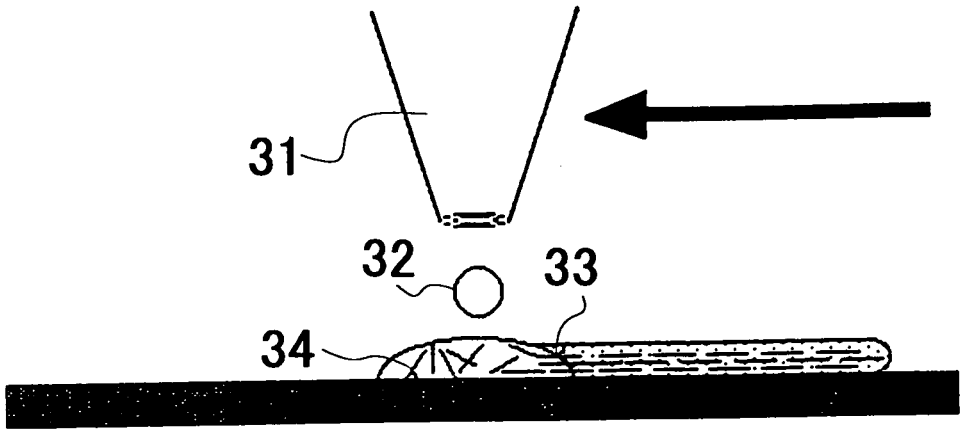
FIGS. 27(*a*) to 27(*b*) are explanatory diagrams of high-degree alignment of a polymer and a precursor thereof, which are obtained by an ultrafine fluid jet apparatus according to the present invention.
Figure 27:
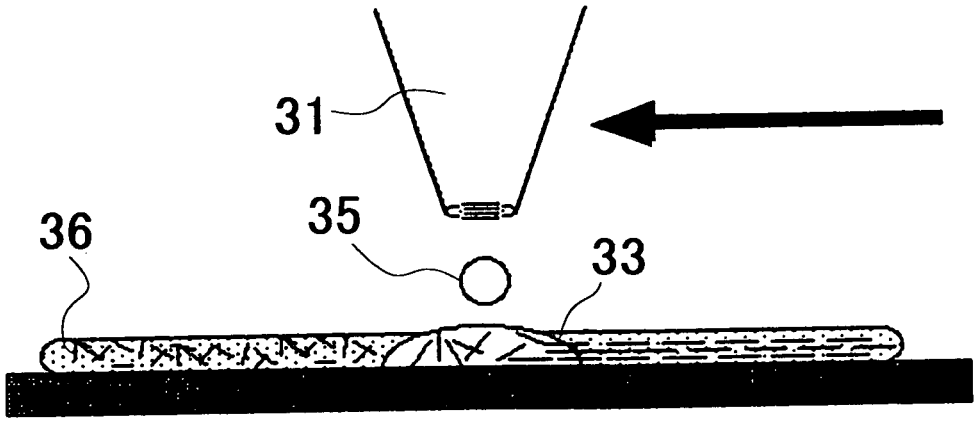

FIGS. 27(*a*) and 27(*b*) show an example of high-degree alignment of a polymer and an precursor thereof obtained by the ultrafine fluid jet apparatus according to the present invention. As shown in FIG. 27(*a*), since a fluid droplet 32 obtained by this jet fluid so small that it is evaporated immediately after landing on a substrate, and a solute (in this case, conductive polymer) dissolved in a solvent is condensed and solidified. A liquid-phase region formed by a jet fluid moves with movement of a nozzle 31. At this time, high-degree alignment of a polymer 34 is realized by a conspicuous dragging effect (advective accumulation effect) obtained in a solid-liquid interface (transition region) 33. In a conventional technique, such high-degree of alignment is mainly obtained by a rubbing method, and it is very difficult to locally align a polymer. FIG. 27(*b*) shows a case in which lines or the like are formed by inkjet printing, and only the solvent 32 is ejected by an ultrafine fluid jet apparatus and aligned. It was found that, a portion to be aligned is locally sprayed with a solvent, and the nozzle 31 is scanned a plurality of times, so that a soluble polymer 36 is ordered and aligned by a dragging effect and zone melting in the solid-liquid interface (transition region) 33. In fact, the effect was confirmed by an experiment using a p-xylene solution of MEH-PPV, a chloroform solution, a dichlorobenzene solution, and the like.

Figure 28:
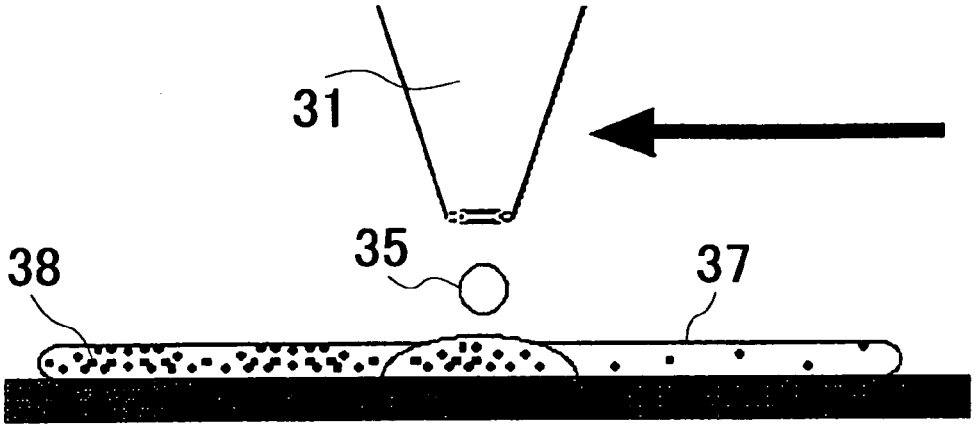
FIG. 28 is an explanatory diagram of zone refining performed by an ultrafine fluid jet apparatus according to the present invention.

FIG. 28 shows an example of zone refining performed by the ultrafine fluid jet apparatus according to the present invention. A phenomenon itself of movement of a material in a solid-liquid interface is described in, for example, R. D. Deegan, et al., Nature, 389, 827 (1997) or the like. As described in FIGS. 27(*a*) and 27(*b*), for example, when the nozzle 31 is scanned on a polymer pattern or the like, while a solvent 35 is ejected using the ultrafine fluid jet apparatus in order to move the liquid-phase region. Whereby, an impurity solute concentration decreases after the nozzle is moved, as an impurity 38 or the like is dissolved in a liquid-phase region 37 due to a difference in solubility. This is achieved by the same effect as that of zone melting or zone refining just used in purification of an inorganic semiconductor. In a conventional technique, an inorganic semiconductor is partially dissolved by heat, however, in this embodiment, the polymer pattern is partially dissolved by a jet fluid. In the present invention, it is a great characteristic feature that purification can be performed on a substrate.

Figure 29:
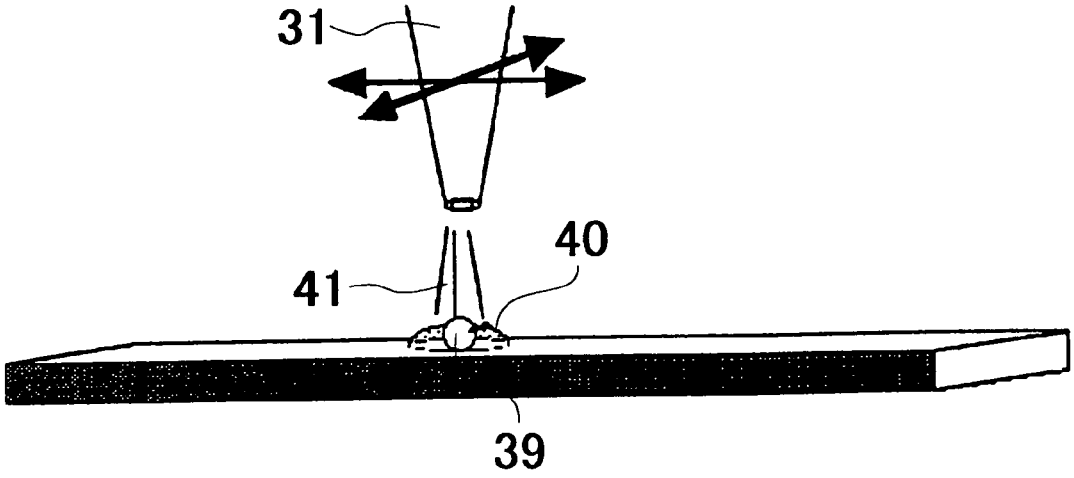
FIG. 29 is an explanatory diagram of micro-bead manipulation performed by an ultrafine fluid jet apparatus according to the present invention.
Figure 30A:
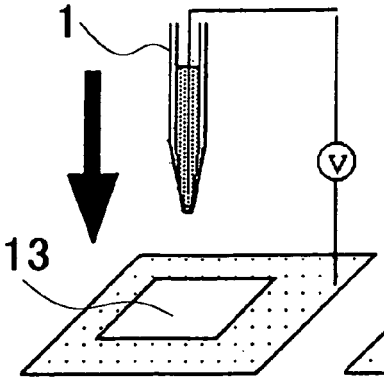
FIGS. 30(*a*) to 30(*g*) are explanatory diagrams of an active tapping apparatus using an ultrafine fluid jet apparatus according to the present invention.
Figure 30B:
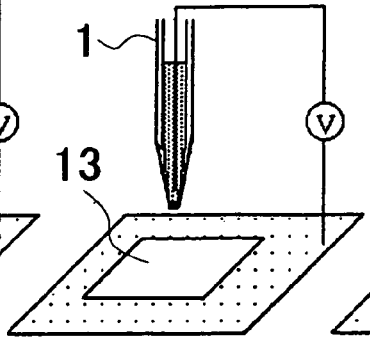
Figure 30C:
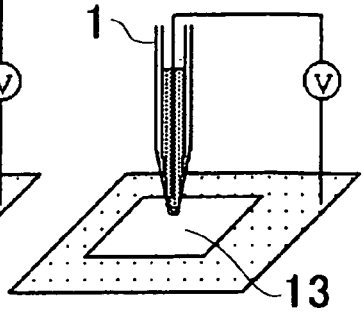
Figure 30D:
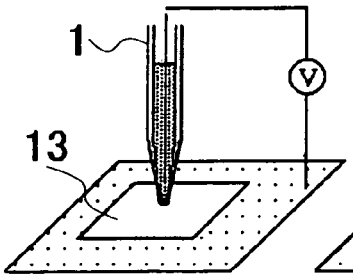
Figure 30E:
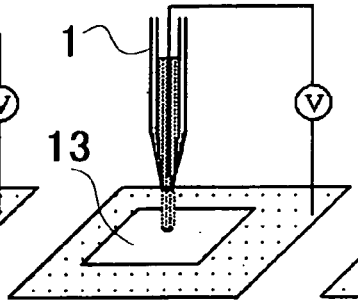
Figure 30F:
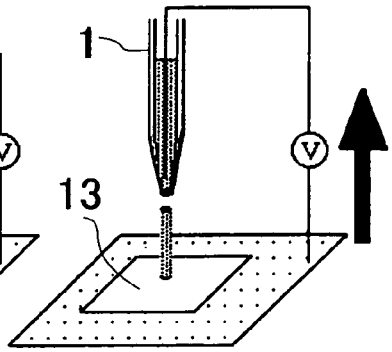
Figure 30G:
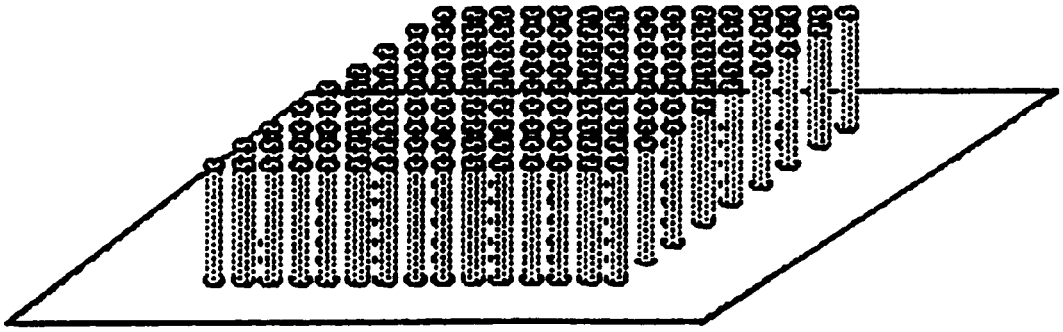

FIG. 29 shows an example of micro-bead manipulation performed by the ultrafine fluid jet apparatus according to the present invention. In FIG. 29, reference numeral 31 denotes a nozzle, reference numeral 40 denotes a fine liquid-phase region, and reference numeral 41 denotes a jet of solvent. When there is a position where water is locally evaporated in a thin water film or the like, a solution is intensively flowed into the position from its periphery, and the particles are accumulated by the flows. This phenomenon is known as advective accumulation. When these flows are controlled by using the ultrafine fluid jet apparatus to cause the advective accumulation, micro-beads 39 such as silica beads can be controlled and operated. The advective accumulation itself is described in, for example, S. I. Matsushita et al., langmuir, 14, p. 6441 (1998).

(Application Examples of Ultrafine Fluid Jet Apparatus)

The ultrafine fluid jet apparatus according to the present invention can be preferably applied to the following apparatus.

[Active Tapping]

FIGS. 30(*a*) to 30(*g*) show an example of an active tapping apparatus using the ultrafine fluid jet apparatus according to the present invention. A nozzle 1 is supported to be perpendicular to a substrate 13, and the nozzle 1 is brought into contact with the substrate 13. A tapping operation at this time is actively performed by an actuator or the like. When the nozzle 1 is brought into contact with the substrate 13, fine patterning can be performed.

For example, a cantilever type nozzle is fabricated by heating and drawing a GD-1 glass capillary available from NARISHIGE CO., LTD. and then bending the distal end of the glass capillary at the position of several ten microns from the end by a heater. A fluorescent dye (obtained by diluting ink of a highlight pen available from ZEBRA CO., LTD. with water to about tenfold) is used as solution. The cantilever is sucked onto the silicon substrate by applying a single-voltage pulse, an AC voltage, or the like to the silicon substrate. It could be confirmed that the fluorescent dye was printed on the substrate.

Further, the characteristic feature of this method is as follows. That is, in the case that a proper solution, e.g., an ethanol solution of polyvinylphenol is used, a fine DC voltage is applied when the substrate 13 is in contact with the nozzle 1 as shown in FIGS. 30(*a*) to 30(*e*), the solution is condensed in the nozzle, and a three-dimensional structure is formed with pulling-up of the nozzle 1 as shown in FIG. 30(*g*).

Figure 31:
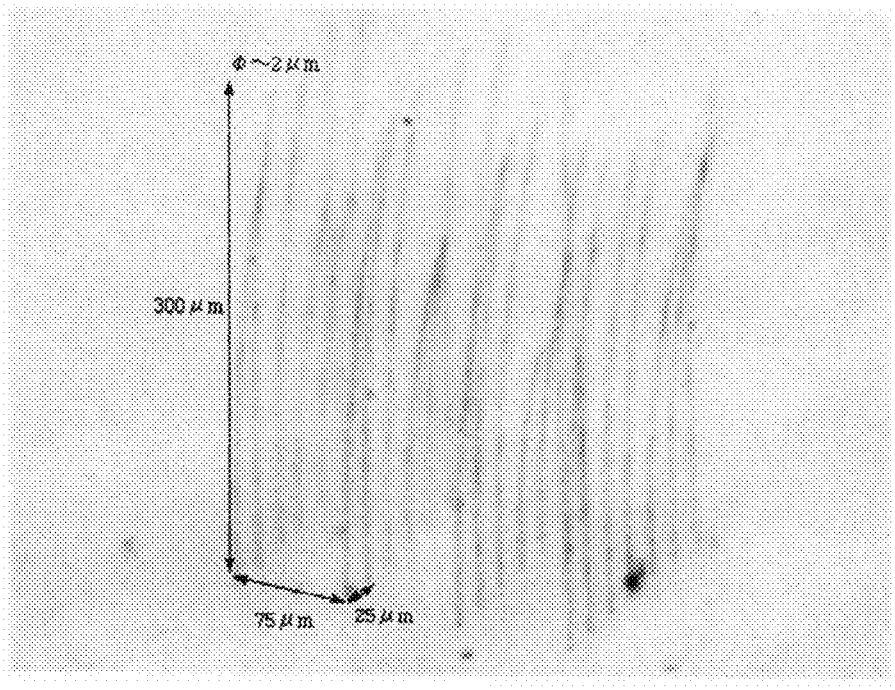
FIG. 31 is a photograph showing an example of three-dimensional structure formation performed by an active tapping apparatus using an ultrafine fluid jet apparatus according to the present invention.

FIG. 31 shows an example of formation of a three-dimensional structure by an active tapping apparatus using the ultrafine fluid jet apparatus according to the present invention. As a solution, an ethanol solution of polyvinylphenol (PVP) was used. In this example, an obtained structure is successfully formed such that cylindrical structures each having a diameter of 2 μm and a height of about 300 μm are arranged in the pattern of a grating having a size of 25 μm×75 μm. The three-dimensional structure formed in this manner may be molded by a resin or the like, using the resultant structure as a casting mold, a fine structure or a fine nozzle, which can hardly be realized by conventional mechanical cutting process, can be manufactured.

[Semicontact Print]

Figure 32:
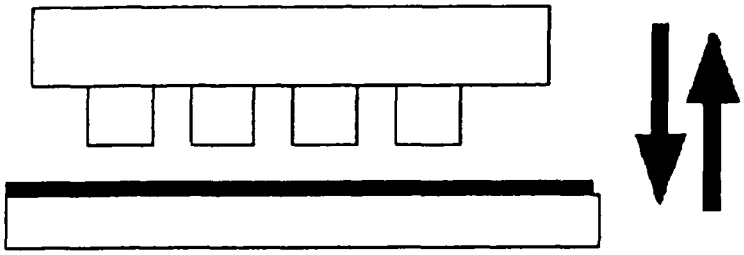
FIGS. 32(*a*) to 32(*c*) are explanatory diagrams of a semi-contact print apparatus using an ultrafine fluid jet apparatus according to the present invention.
Figure 32:
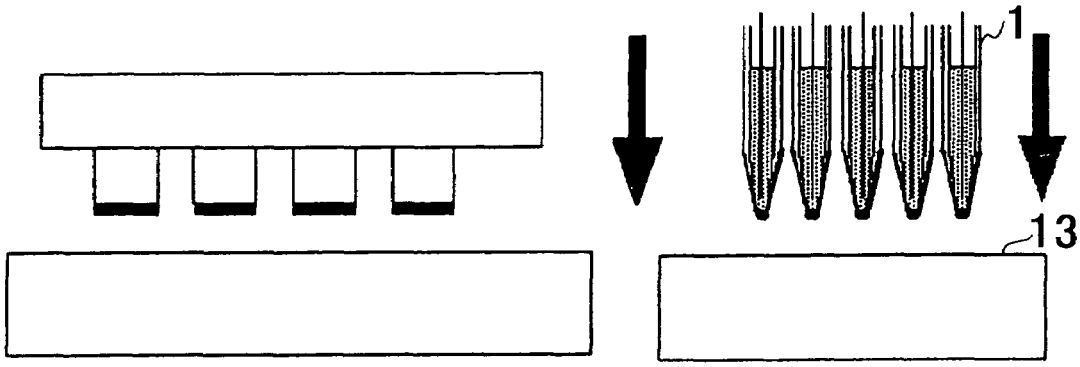
Figure 32:
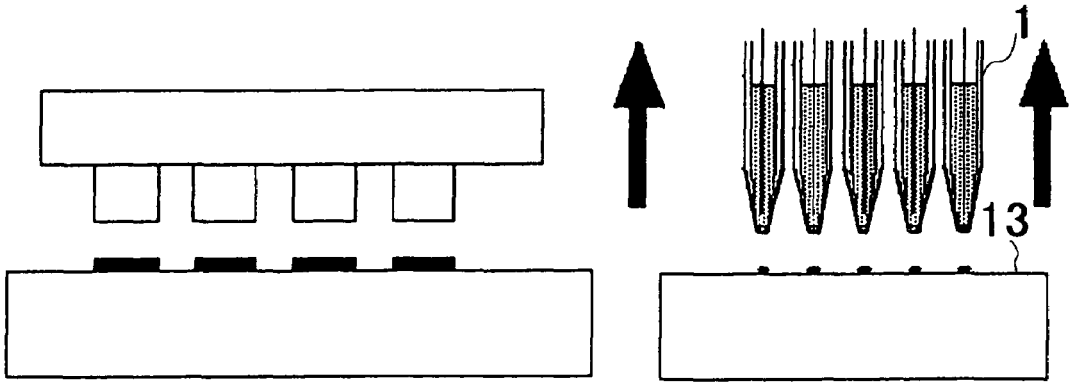

FIGS. 32(*a*) to 32(*c*) show a semicontact print apparatus using the ultrafine fluid jet apparatus according to the present invention. In general, the nozzle 1 having a thin capillary shape is kept perpendicular to the substrate 13. However, in the semicontact print apparatus, when the nozzle 1 is obliquely arranged to the substrate 13, or the distal end of the nozzle 1 is bent at 90° and held horizontal, and a voltage is applied, the nozzle 1 is brought into contact with the substrate 13 by electrostatic force acting between the substrate 13 and the nozzle 1 because the capillary is very thin. At this time, printing with a similar size of the distal end of the nozzle 1 can be performed on the substrate 13. In this case, electrostatic force is used. However, active methods such as those using magnetic force, a motor, piezoelectric force, or the like, may be used.

FIG. 32(*a*) shows a process which is required only in a conventional contact print method, which is a process of transferring an object material to a plate. After a pulse voltage is applied, as shown in FIG. 32(*b*), a capillary starts to move and contact with a substrate. At this time, a solution is present in the nozzle 1 at the distal end of the capillary. As shown in FIG. 32(*c*), after the nozzle 1 and the substrate 13 are in contact with each other, the solution moves onto the substrate 13 by capillary force acting between the nozzle 1 and the substrate 13. At this time, clogging of the nozzle 1 is relieved.

Although the nozzle 1 is brought into contact with the substrate 13 through the solution, the nozzle 1 is not in direct contact with the substrate 13 (This state is referred to as "semicontact print".). Therefore, the nozzle 1 is not worn.

As described above, a conventional electrohydrodynamic inkjet has a requirement in which an unstable surface is formed by an electric field caused by a voltage applied to the nozzle and an inter-nozzle-substrate (or inter-nozzle-counter-electrode) distance. In the conventional inkjet, a driving voltage of 1000 V or less can hardly achieved.

In contrast to this, the present invention targets a nozzle having a diameter which is equal to or smaller than that of the nozzle of the conventional electrohydrodynamic inkjet. It is utilized that an electric field concentration effect at the distal end of the nozzle is higher as the nozzle becomes finer (miniaturization and precision, and decrease in voltage). In addition, it is utilized that a conductance decreases as the nozzle become finer (miniaturization). Acceleration by an electric field is utilized (position accuracy). Image force is utilized (insulating substrate and position accuracy). A dielectric response effect is utilized (switching). Moderation of evaporation by charging is utilized (improvement in positioning accuracy and miniaturization). Furthermore, an electrowetting effect is utilized (improvement in ejection output).

The present invention has the following advantages.

(1) Formation of ultrafine dot, which can hardly be obtained by a conventional inkjet system, can be obtained by an ultrafine nozzle.

(2) Formation of ultrafine droplet and improvement in landing accuracy, which can hardly be compatible by a conventional inkjet system, can be compatible.

(3) A decrease in driving voltage, which can hardly be achieved by a conventional electrohydrodynamic inkjet system, can be achieved.

(4) Due to a low driving voltage and a simple structure, a high-density multi-nozzle structure, which can hardly be achieved by a conventional electrohydrodynamic inkjet, becomes easy.

(5) A counter electrode(s) can be omitted.

(6) A low-conductive solution, which can hardly be used in a conventional electrohydrodynamic inkjet system, can be used.

(7) By employing a fine nozzle, voltage controllability is improved.

(8) Formation of a thick film, which can hardly be achieved by a conventional inkjet system, can be achieved.

(9) A nozzle consists of an electric insulator, and an electrode is arranged so as to be dipped in a solution in the nozzle, or is formed in the nozzle by plating or vapor deposition, so that the nozzle can be used as an electrode. In addition, an electrode is arranged outside the nozzle, so that ejection control by an electrowetting effect can be performed.

(10) A fine capillary tube consisting of glass being used as a nozzle, a low conductance can be easily achieved.

(11) A flow passage having a low conductance is connected to a nozzle, or the nozzle itself has a shape having a low conductance, so that an ultrafine droplet size can be obtained.

(12) An insulating substrate such as a glass substrate can be used, and a conductive-material substrate can also be used as a substrate.

(13) A distance between a nozzle and a substrate is set at 500 μm, so that uneven portions on the surface of the substrate may prevent from contacting with the distal end of the nozzle while improving landing accuracy.

(14) When a substrate is placed on a conductive or insulating substrate holder, the substrate can be easily replaced with another substrate.

(15) When a pressure is put on a solution in a nozzle, a conductance can be easily regulated.

(16) By using an optional-waveform voltage, wherein a polarity and a pulse width are optimized in accordance with the characteristics of a solution, a time change in composition of an ejection fluid can be minimized.

(17) A pulse width and a voltage are variable by an optional-waveform voltage generation device, so that a dot size can be changed.

(18) As an applied optional-waveform voltage, any one of a DC voltage, a pulse-waveform voltage, and an AC voltage can be used.

(19) Nozzle clogging is less frequent by AC drive, and stable ejection can be maintained.

(20) Accumulation of charges on an insulating substrate can be minimized by AC drive, landing accuracy and ejection controllability are improved.

(21) By using an AC voltage, phenomena of spreading and blurring of a dot on a substrate can be minimized.

(22) Switching characteristics are improved by On/Off control performed by frequency modulation.

(23) An optional-waveform voltage applied to a nozzle is driven in a predetermined region, so that a fluid can be ejected by electrostatic force.

(24) When an applied optional-waveform voltage is 700 V or less, ejection can be controlled by using a nozzle having a diameter of 25 μm. When the voltage is 500 V or less, ejection can be controlled by using a nozzle having a diameter of 10 μm.

(25) When a distance between a nozzle and a substrate is kept constant, and when ejection of a fluid droplet is controlled by controlling an applied optional waveform, the ejection of the fluid droplet can be controlled without changing the distance between the nozzle and the substrate.

(26) When an applied optional waveform is kept constant, and when ejection of a fluid droplet is controlled by controlling a distance between a nozzle and a substrate, the ejection of the fluid droplet can be controlled while keeping the voltage constant.

(27) When ejection of a fluid droplet is controlled by controlling a distance between a nozzle and a substrate and an applied optional waveform, On/Off control of the ejection of the fluid droplet can be performed by an optional distance and an optional voltage.

(28) When an applied optional waveform is an AC waveform, and when a meniscus shape of a fluid on a nozzle end face is controlled by controlling the frequency of the AC voltage to control ejection of a fluid droplet, excellent printing can be achieved.

(30) When On/Off ejection control is performed by modulation at frequencies f which sandwich a frequency expressed by $f=\sigma/2\pi\in$, ejection control by modulation of a frequency can be performed at a constant inter-nozzle-substrate distance L.

(31) When ejection is performed by a single pulse, a droplet can be formed by applying a pulse width $\Delta t$ which is not less than a time constant $\tau$.

(32) When a flow rate per unit time in application of a driving voltage is set to be $10^{-10}$ $m^3/s$ or less, a micro flow rate of an ejected solution can be accurately controlled.

(33) When the ultrafine fluid jet apparatus is used in formation of a circuit pattern, a circuit pattern having a fine line width and a fine interval can be formed.

(34) When the ultrafine fluid jet apparatus is used in formation of a circuit pattern using metal ultrafine particles, a thin-line pattern having excellent conductivity can be formed.

(35) When the ultrafine fluid jet apparatus is used in formation of carbon nanotubes, a precursor thereof, and a catalytic alignment, carbon nanotubes or the like can be locally generated on a substrate by the alignment of catalysts.

(36) By the ultrafine fluid jet apparatus, a three-dimensional structure which is applicable to form a patterning of ferroelectric ceramics and a precursor thereof, to be an actuator or the like, can be formed.

(37) When the ultrafine fluid jet apparatus is used in high-degree alignment of a polymer and a precursor thereof, formation of a high-order structure such as alignment of the polymer can be performed.

(38) When the ultrafine fluid jet apparatus is used in zone refining, purification can be performed on a substrate, and an impurity in a solute can be condensed by zone melting.

(39) When the ultrafine fluid jet apparatus is used in micro-bead manipulation, micro balls such as silica beads can be handled.

(40) When a nozzle is actively tapped to a substrate, fine patterning can be performed.

(41) When the ultrafine fluid jet apparatus is used in formation of a three-dimensional structure, a micro three-dimensional structure can be formed.

(42) When a nozzle is obliquely arranged with respect to a substrate, semicontact print can be performed.

(43) When a vector scan scheme is employed, circuit patterning is rarely disconnected at a step for forming a continuous line.

(44) When a raster scan scheme is employed, one screen of image can be displayed by using scanning lines.

(45) A PVP ethanol solution is spin-coated on a substrate to make it easy to modify a substrate surface.

INDUSTRIAL APPLICABILITY

As has been described above, in an ultrafine fluid jet apparatus according to the present invention, an ultrafine dot, which cannot be easily formed by a conventional inkjet scheme, can be formed by an ultrafine nozzle. The ultrafine fluid jet apparatus can be applied to dot formation, circuit pattern formation by metal paticulates, ferroelectric ceramics patterning formation, conductive polymer alignment formation, and the like.

Having described our invention as related to the present embodiments, it is our intention that the invention not be limited by any of the details of the description, unless otherwise specified, but rather be construed broadly within its spirit and scope as set out in the accompanying claims.

The invention claimed is:

1. An ultrafine fluid jet apparatus, comprising:

an ultrafine-diameter nozzle member comprising an ultrafine capillary tube that is tapered towards its distal end and is capable of being supplied with a liquid, in which the nozzle member has an inner diameter in the range of from 0.01 μm to 8 μm at the distal end of the tapered ultrafine capillary tube, and the nozzle member is made of an electric insulator, an electrode provided in or on the nozzle member being extended into the tapered section of the nozzle member, and a device for generating an optional-waveform voltage to be applied to the electrode, for ejecting an ultrafine-diameter fluid droplet of the liquid from the nozzle member;

wherein, upon i) applying optional-waveform voltage of 1000V or less, ii) supplying the nozzle member with the liquid, and iii) positioning a substrate close to the distal end of the nozzle member, an electric field is focused onto the distal end of the nozzle member so as to increase a density of electric flux lines drawn from the nozzle member toward the substrate to which the fluid droplet lands, and the ultrafine-diameter fluid droplet is ejected from the nozzle member and lands on a prescribed point on the substrate which is close to the distal end of the nozzle member.

2. The ultrafine fluid jet apparatus described in claim 1, wherein the nozzle member is supplied with the liquid and the electrode is arranged to be dipped in the liquid, or the electrode is formed by plating, or vapor deposition on an inner surface of the nozzle member.

3. The ultrafine fluid jet apparatus described in claim 2, wherein an optional-waveform voltage is applied to the electrode arranged to be dipped in the liquid in the nozzle member, or an optional-waveform voltage is applied to the electrode formed by plating, or vapor deposition on the inner surface of the nozzle member.

4. The ultrafine fluid jet apparatus described in claim 3, wherein the applied optional-waveform voltage is a DC voltage.

5. The ultrafine fluid jet apparatus described in claim 3, wherein the applied optional-waveform voltage is a pulse waveform.

6. The ultrafine fluid jet apparatus described in claim 3, wherein the applied optional-waveform voltage is an AC voltage.

7. The ultrafine fluid jet apparatus described in claim 6, wherein the applied optional-waveform voltage is an AC voltage, and a meniscus shape of the fluid on the nozzle end face is controlled by controlling a frequency of the AC voltage, to control ejection of the fluid droplet.

8. The ultrafine fluid jet apparatus described in claim 1, wherein the electrode is provided on an outer surface of the nozzle member.

9. The ultrafine fluid jet apparatus described in claim 1, wherein a flow passage of low conductance is connected to the nozzle member, or the nozzle member itself has a shape having low conductance.

10. The ultrafine fluid jet apparatus described in claim 1, wherein the substrate is made of a conductive material or an insulating material.

11. The ultrafine fluid jet apparatus described in claim 1, wherein the distance between the nozzle member and the substrate is 500 μm or less.

12. The ultrafine fluid jet apparatus described in claim 1, wherein the substrate is placed on a conductive or insulating substrate holder.

13. The ultrafine fluid jet apparatus described in claim 1, wherein the nozzle member is supplied with the liquid and pressure is applied to the liquid in the nozzle member.

14. The ultrafine fluid jet apparatus described in claim 1, wherein the optional-waveform voltage V (volt) applied to the nozzle member is given in a region expressed by:

$$\sqrt[4]{\frac{\gamma\pi}{\varepsilon_0 d}} > V > \sqrt{\frac{\gamma k d}{2\varepsilon_0}} \tag{15}$$

and wherein γ is a surface tension (N/m) of the fluid, $\in_0$ is the dielectric constant (F/m) of a vacuum, d is a nozzle member diameter (m), h is a distance between the nozzle member and the substrate (m), and k is a the proportionality constant (1.5<k<8.5) depending on nozzle member shape.

15. The ultrafine fluid jet apparatus described in claim 1, wherein the applied optional-waveform voltage is 700 V or less.

16. The ultrafine fluid jet apparatus described in claim 1, wherein the applied optional-waveform voltage is 500 V or less.

17. The ultrafine fluid jet apparatus described in claim 1, wherein the distance between the nozzle member and the substrate is made constant, and the applied optional-waveform voltage is controlled to control ejection of the fluid droplet.

18. The ultrafine fluid jet apparatus described in claim 1, wherein the applied optional-waveform voltage is made constant, and the distance between the nozzle and the substrate is controlled to control ejection of the fluid droplet.

19. The ultrafine fluid jet apparatus described in claim 1, wherein the distance between the nozzle member and the substrate, and the applied optional-waveform voltage, are controlled to control ejection of the fluid droplet.

20. The ultrafine fluid jet apparatus described in claim 1, wherein an operating frequency used when ejection is controlled is modulated by frequencies f (Hz), which sandwich a frequency, and which is expressed by:

$$f=\sigma/\pi\in$$

to perform ON-OFF ejection control, and wherein σ is a dielectric constant ($S\cdot m^{-1}$) of the fluid, and ∈ is a specific inductive capacity of the fluid.

21. The ultrafine fluid jet apparatus described in claim 1, wherein, when ejection is performed by a single pulse, a pulse width Δt having a time constant τ or more determined by:

$$\tau = \frac{\varepsilon}{\sigma} \tag{20}$$

is applied, and wherein ∈ is a specific inductive capacity of the fluid, and σ is a conductivity ($S\cdot m^{-1}$) of the fluid.

22. The ultrafine fluid jet apparatus described in claim 1,wherein, a flow rate per unit time in application of a driving voltage is set at $10^{-10}$ $m^3/s$ or less when the flow rate Q in a cylindrical flow passage is expressed by:

$$Q = \frac{4\pi d^3}{\eta L}\left(\frac{2\varepsilon_0 V^2}{kd} - \gamma\right) \tag{19}$$

and wherein d is a diameter (m) of the flow passage, η is a viscosity coefficient (Pa·s) of the fluid, L is a length (m) of the flow passage, $\in_0$ is the dielectric constant ($F\cdot m^{-1}$) of a vacuum, V is an applied voltage (V), γ is a surface tension ($N\cdot m^{-1}$) of the fluid, and k is a proportionality constant (1.5<k<8.5) depending on nozzle member shape.

23. The ultrafine fluid jet apparatus described in claim 1, which is used in formation of a circuit pattern.

24. The ultrafine fluid jet apparatus described in claim 1, which is used in formation of a circuit pattern using metal ultrafine particles.

25. The ultrafine fluid jet apparatus described in claim 1, which is used in formation of a carbon nanotube, a precursor thereof, and a catalytic configuration.

26. The ultrafine fluid jet apparatus described in claim 1, which is used in formation of a patterning of ferroelectric ceramics and a precursor thereof.

27. The ultrafine fluid jet apparatus described in claim 1, which is used in high-degree configuration for a polymer and a precursor thereof.

28. The ultrafine fluid jet apparatus described in claim 1, which is used in zone refining.

29. The ultrafine fluid jet apparatus described in claim 1, which is used in micro-bead manipulation.

30. The ultrafine fluid jet apparatus described in claim 1, wherein the nozzle is actively tapped to the substrate.

31. The ultrafine fluid jet apparatus described in claim 30, which is used in the formation of a three-dimensional structure.

32. The ultrafine fluid jet apparatus described in claim 1, wherein the nozzle member is arranged obliquely to the substrate.

33. The ultrafine fluid jet apparatus described in claim 1, wherein a vector scan system is employed.

34. The ultrafine fluid jet apparatus described in claim 1, wherein a raster scan system is employed.

35. The ultrafine fluid jet apparatus described in claim 1, wherein a polyvinylphenol (PVP) ethanol solution is spin-coated on the substrate to modify the surface of the substrate.

36. The ultrafine fluid jet apparatus according to claim 1, wherein the optional-waveform voltage is adjusted in accordance with a distance between the nozzle member and the substrate, and wherein a fluid meniscus shape is controlled at the distal end of the nozzle member to increase the focused electric field for reaching or exceeding an ejection boundary.

37. The ultrafine fluid jet apparatus according to claim 1, wherein the nozzle member is made of glass, the electrode is made of tungsten, and the optional-waveform voltage is a sine or rectangular wave AC signal.

38. The ultrafine fluid jet apparatus described in claim 1, wherein the nozzle member has a nozzle hole having a diameter of 2 μm or less.

39. The ultrafine fluid jet apparatus described in claim 1, wherein the nozzle member has a nozzle hole having a diameter of 1 μm or less.

40. A method of ejecting an ultrafine-diameter fluid droplet, comprising:

(i) providing an ultrafine fluid jet apparatus which comprises:

an ultrafine-diameter nozzle member comprising an ultrafine capillary tube that is tapered towards its distal end and supplied with a liquid, in which the nozzle member has an inner diameter in the range of from 0.01 μm to 8 μm at the distal end of the tapered ultrafine capillary tube, and the nozzle member is made of an electric insulator, an electrode provided in or on the nozzle member being extended into the tapered section of the nozzle member, and a device for generating an optional-waveform voltage, (ii) applying an optional-waveform voltage to the electrode provided in or on the nozzle member, with an applied voltage of 1000V or less, for focusing an electric, field onto the distal end of the nozzle member so as to increase a density of electric flux lines drawn from the nozzle member toward a substrate which is close to the distal end of the nozzle member, and (iii) ejecting an ultrafine-diameter droplet of the liquid in which evaporation of the droplet is controlled by the focused electric field, and guiding the droplet from the nozzle member so that it lands on a prescribed point on the substrate.

41. The method of ejecting an ultrafine-diameter fluid droplet according to claim 40, wherein the optional-waveform voltage is adjusted in accordance with a distance between the nozzle member and the substrate, and wherein a fluid meniscus shape is controlled at the distal end of the nozzle member to increase the focused electric field for reaching or exceeding an ejection boundary.

42. A method of forming a circuit pattern, comprising ejecting a conductive material onto a substrate, in accordance with the method of ejecting an ultrafine-diameter fluid droplet of claims 40 or 41.

43. An ultrafine fluid jet apparatus, consisting essentially of:

an ultrafine-diameter nozzle member comprising an ultrafine capillary tube that is tapered towards its distal end and is capable of being supplied with a liquid, in which the nozzle member has an inner diameter in the range of from 0.01 μm to 8 μm at the distal end of the tapered ultrafine capillary tube, and the nozzle member is made of an electric insulator, an electrode provided in or on the nozzle member being extended into the tapered section of the nozzle member, and a device for generating an optional-waveform voltage to be applied to the electrode, for ejecting an ultrafine-diameter fluid droplet of the liquid from the nozzle member;

wherein, upon i) applying optional-waveform voltage of 1000V or less, ii) supplying the nozzle member with the liquid, and iii) positioning a substrate close to the distal end of the nozzle member, an electric field is focused onto the distal end of the nozzle member so as to increase a density of electric flux lines drawn from the nozzle member toward the substrate to which the fluid droplet lands, and the ultrafine-diameter fluid droplet is ejected from the nozzle member and lands on a prescribed point on the substrate which is close to the distal end of the nozzle member.

* * * * *